US006149769A

United States Patent [19]

Mohammadi et al.

[11] Patent Number: 6,149,769

[45] Date of Patent: Nov. 21, 2000

[54] SOFT TISSUE HAVING TEMPORARY WET STRENGTH

[75] Inventors: Khosrow Parviz Mohammadi, West Chester; Larry Odell Seward; David Mark Rasch, both of Cincinnati, all of Ohio

[73] Assignee: The Procter & Gamble Company, Cincinnati, Ohio

[21] Appl. No.: 09/089,809

[22] Filed: Jun. 3, 1998

[51] Int. Cl.[7] ..... D21H 21/20

[52] U.S. Cl. ..... 162/111; 162/109; 162/112; 162/113; 162/123; 162/125; 162/127; 162/129; 162/130; 162/158; 162/164.1; 162/164.6; 162/168.1; 162/168.2; 162/168.3; 162/175; 162/183

[58] Field of Search ..... 162/112, 158, 162/168.3, 113, 168.1, 111, 109, 123, 125, 127, 164.1, 175, 164.6, 129, 130

[56] References Cited

U.S. PATENT DOCUMENTS

| | | | |
|---|---|---|---|
| 3,703,623 | 11/1972 | Swengel, Sr. | 219/137 |
| 3,755,220 | 8/1973 | Freimark et al. | 260/17.3 |
| 4,637,859 | 1/1987 | Trokhan | 162/109 |
| 4,981,557 | 1/1991 | Bjorkquist | 162/168.2 |
| 5,690,790 | 11/1997 | Hedlam et al. | 162/183 |
| 5,723,022 | 3/1998 | Dauplaise | 162/168.3 |

FOREIGN PATENT DOCUMENTS 1494546 12/1977 United Kingdom .

OTHER PUBLICATIONS

Smook, G. A., B: "Handbook for Pulp & Paper Technologist", Ed. M.J. Kocurek, (1989).

*Primary Examiner*—Peter Chin
*Attorney, Agent, or Firm*—Donald E. Hasse; Edward J. Milbrada; Larry L. Huston

[57] ABSTRACT

Disclosed is a soft, low density paper product made using papermaking fibers and a cationic temporary wet strength resin. Such paper products have a density less than about 0.6 grams per cubic centimeter, a basis weight is between about 10 and about 65 grams per square meter, a dry strength less than about 500 grams per inch (197 grams per centimeter), a ratio of an initial wet strength to the dry strength greater than about 0.15:1, and a ratio of a thirty minute wet strength to the initial wet strength less than about 0.4. Methods for producing such paper products are also disclosed. The paper products may be produced either as homogeneous structures or as multi-layered structures and may be either creped or uncreped.

33 Claims, 3 Drawing Sheets

SOFT TISSUE HAVING TEMPORARY WET STRENGTH

FIELD OF THE INVENTION

The invention relates to paper products having temporary wet strength. The invention especially relates to paper products having temporary wet strength that are desirably soft while possessing the ability to rapidly disperse when exposed to conventional sewage systems.

BACKGROUND OF THE INVENTION

Paper webs or sheets, sometimes called tissue or paper tissue webs or sheets, find extensive use in modem society. These include such staple items as paper towels, facial tissues and sanitary (or toilet) tissues. These paper products can have various desirable properties, including wet and dry strength, softness, and lint resistance.

Strength is the ability of the product, and its constituent webs, to maintain physical integrity and to resist tearing, bursting, and shredding under use conditions, particularly when wet.

Softness is the tactile sensation perceived by the consumer as he/she holds a particular product, rubs it across his her skin, or crumples it within his her hand. This tactile sensation is provided by a combination of several physical properties. Important physical properties related to softness are generally considered by those skilled in the art to be the stiffness, the surface smoothness and lubricity of the paper web from which the product is made. Stiffness, in turn, is usually considered to be directly dependent on the dry strength of the web and the stiffness of the fibers which make up the web. In particular, as dry strength increases, softness decreases.

Lint resistance is the ability of the fibrous product, and its constituent webs, to bind together under use conditions, including when wet. In other words, the higher the lint resistance is, the lower the propensity of the web to lint will be.

The dry strength of paper products should be sufficient to enable manufacture of the product and use of the product in a relatively dry condition. Increases in dry strength can be achieved either by mechanical processes to insure adequate formation of hydrogen bonding between the hydroxyl groups of adjacent papermaking fibers, or by the inclusion of certain dry strength additives. Such dry strength additives are typically natural or synthetic polymers. Exemplary dry strength additives include: starch and starch derivatives, polyvinyl alcohol, and polyacrylamide.

Wet strength is a desirable attribute of many disposable paper products that come into contact with aqueous fluids in use, such as napkins, paper towels, household tissues, disposable hospital wear, etc. In particular, it is often desirable that such paper products have sufficient wet strength to enable their use in a moistened or wet condition. For example, a moistened tissue or towel may be used for body or other cleaning. Unfortunately, an untreated cellulose fiber assemblage will typically lose 95% to 97% of its strength when saturated with water such that it cannot usually be used in the moistened or wet condition.

Historically, one approach to providing wet strength to paper products is to incorporate additives in the paper product which contribute toward the formation of interfiber bonds which are not broken or, for temporary wet strength, which resist being broken, by water. A water soluble wet strength resin may be added to the pulp, generally before the paper product is formed (wet-end addition). The resin generally contains cationic functionalities so that it can be easily retained by the cellulose fibers, which are naturally anionic.

A number of resins have been used or disclosed as being particularly useful for providing wet strength to paper products. Certain of these wet strength additives have resulted in paper products with permanent wet strength, i.e., paper which when placed in an aqueous medium retains a substantial portion of its initial wet strength over time. Exemplary resins of this type include urea-formaldehyde resins, melamine-formaldehyde resins and polyamide-epichlorohydrin resins. Such resins have limited wet strength decay.

Permanent wet strength in paper products is often an unnecessary and undesirable property. Paper products such as toilet tissues, etc., are generally disposed of after brief periods of use into sewage systems and the like. Clogging of these systems can result if the paper product permanently retains its wet strength properties. Therefore, manufacturers have more recently added temporary wet strength additives to paper products for which wet strength is sufficient for the intended use, but which then decays upon soaking in water. Decay of the wet strength facilitates flow of the paper product through septic systems. Numerous approaches for providing paper products claimed as having good initial wet strength which decays significantly over time have been suggested.

One type of temporary wet strength additive are aldehyde containing resins exemplified by COBOND 1000, an aldehyde functionalized cationic starch commercially available from the National Starch & Chemical Corp. of Bloomfield, N.J., and PAREZ 631 NC and PAREZ 750A, aldehyde functionalized cationic polyacrylamides commercially available from Cytec Industries, Inc. of West Paterson, N.J.

Exemplary patents describing paper products having temporary wet strength include: U.S. Pat. No. 4,981,557, issued to Bjorkquist on Jan. 1, 1991; U.S. Pat. No. 5,690,790, issued to Hedlam, et al. on Nov. 25, 1997; and U.S. Pat. No. 5,723,022, issued to Dauplaise, et al. on Mar. 3, 1998. While all of these patents describe paper products having a decay in strength with time after exposure to water or an aqueous solution, none of them describes low density paper products having a combination of short term maintenance of strength after exposure to water, decay in strength with time after exposure to water and softness as would be particularly desirable for paper products that are used for toweling, sanitary tissue, and the like. In particular, the paper products described by the above-identified patents have dry tensile properties that would suggest a need for improved softness or, in the absence of any disclosure of dry tensile properties, a need for improved short term maintenance of dry strength properties on exposure to water.

Thus, there is a continuing need for improvements in paper products that are used for toweling, sanitary tissue, and the like. In particular, there is a need for paper products that maintain a greater percentage of their dry strength when they are first wetted, while, on further exposure to water or an aqueous solution, showing a substantial decay from their initial wet strength. There is a further need for paper products having such desirable wet strength properties that are also soft and lint resistant.

SUMMARY OF THE INVENTION

The soft, low density paper products of the present invention comprise papermaking fibers and a cationic temporary wet strength resin. Such paper products have a density less than about 0.6 grams per cubic centimeter, a basis weight is between about 10 and about 65 rams per square meter, a dry strength less than about 500 grams per inch (197 grams per centimeter), a ratio of an initial wet strength to the dry strength greater than about 0.15:1, and a ratio of a thirty minute wet strength to the initial wet strength less than about 0.4. The paper products of the present invention may be produced either as homogeneous structures or as multi-layered structures and may be either creped or uncreped.

DETAILED DESCRIPTION OF THE INVENTION

Figure 1:
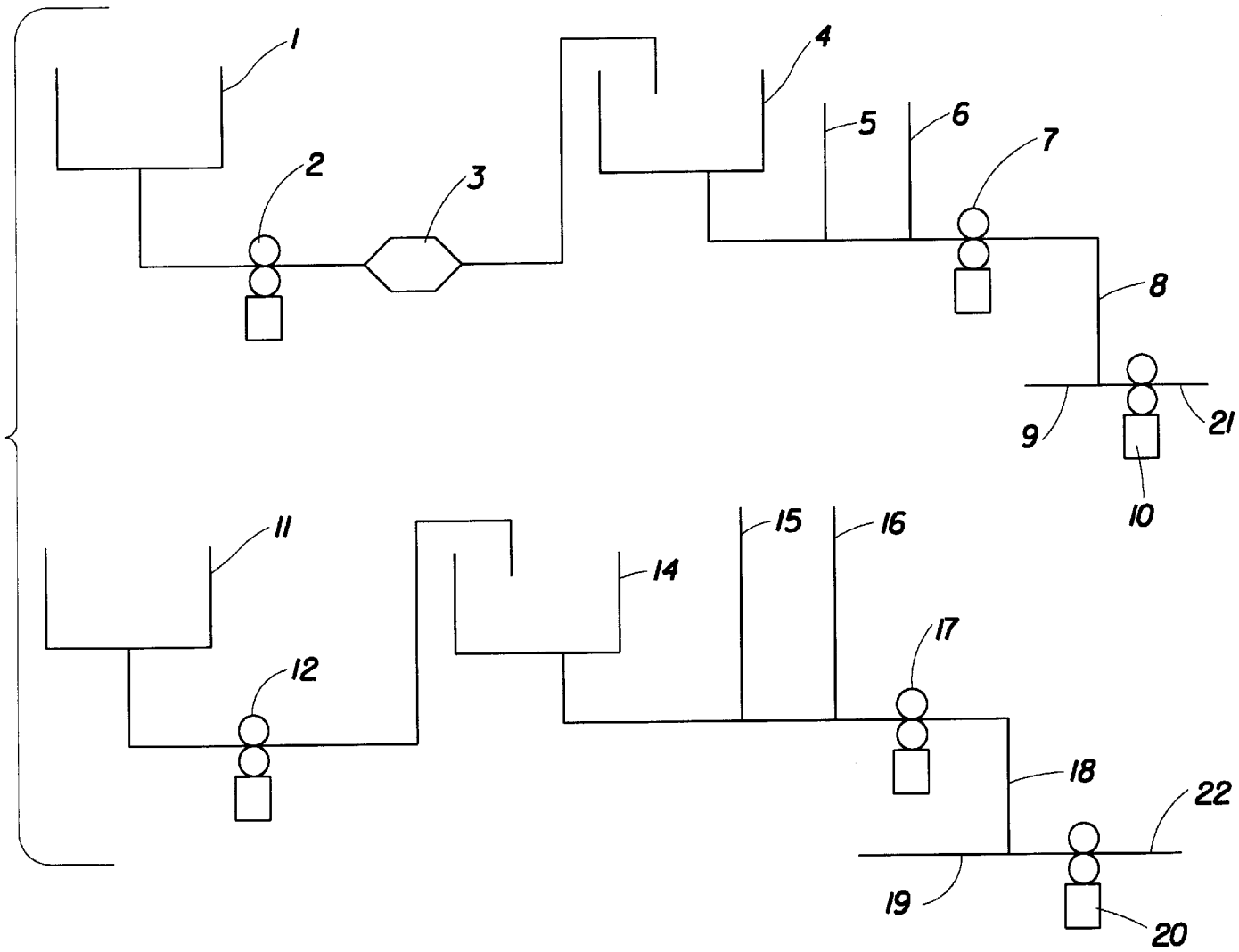
FIG. 1 is a schematic representation illustrating the steps for preparing an aqueous papermaking furnish for a papermaking process suitable for producing the paper product of the present invention.

While this specification concludes with claims particularly pointing out and distinctly claiming the subject matter regarded as the invention, it is believed that the invention can be better understood from a reading of the following detailed description in conjunction with the accompanying figures and of the appended examples.

As used herein, the term "lint resistance" is the ability of the fibrous product, and its constituent webs, to bind together under use conditions, including when wet. In other words, the higher the lint resistance is, the lower the propensity of the web to lint will be.

As used herein, the term "binder" refers to the various wet and dry strength resins and retention aid resins known in the papermaking art.

As used herein, the term "water soluble" refers to materials that are soluble in water to at least 3% at 25° C.

As used herein, the terms "tissue paper web, paper web, web, paper sheet and paper product"all refer to sheets of paper made by a process comprising the steps of forming an aqueous papermaking furnish, depositing this furnish on a foraminous surface, such as a Fourdrinier wire, and removing the water from the furnish as by gravity or vacuum-assisted drainage, with or without pressing, and by evaporation.

As used herein, an "aqueous papermaking furnish" is an aqueous slurry of papermaking fibers and the chemicals described hereinafter.

As used herein, the term "multi-layered tissue paper web, multi-layered paper web, multi-layered web, multi-layered paper sheet and multi-layered paper product" all refer to sheets of paper prepared from two or more layers of aqueous papermaking furnish which are preferably comprised of different fiber types, the fibers typically being relatively long softwood and relatively short hardwood fibers as used in tissue papermaking. The layers are preferably formed from the deposition of separate streams of dilute fiber slurries, upon one or more endless foraminous screens. If the individual layers are initially formed on separate wires, the layers are subsequently combined (while wet) to form a layered composite web.

As used herein the term "multi-ply tissue paper product" refers to a tissue paper consisting of at least two plies. Each individual ply in turn can consist of single-layered or multi-layered tissue paper webs. The multi-ply structures are formed by bonding together two or more tissue webs such as by gluing or embossing.

As used herein the term "through air drying" technique refers to a technique of drying the web by hot air.

As used herein the term "mechanical dewatering" technique refers to a technique of drying the web by mechanical pressing with a dewatering felt.

General Description of the Paper of the Present Invention

Paper according to the present invention has a desirable combination of initial wet strength, wet strength decay, softness and lint resistance. While the prior art typically uses chemical strength additives (dry strength additives, wet strength resins, and the like) to enhance the strength properties of papermaking fibers, the Applicants have found that, when papermaking fibers and a temporary wet strength resin are formed into a paper structure according to the method of the present invention, the resulting low density tissue paper has a unique combination of dry strength, high initial wet strength, rapid wet strength decay, softness, and lint resistance. Each of these properties will be discussed in greater detail below.

Initial Wet Strength

As noted above, the initial wet strength of a paper product is important in maximizing its utility in many use situations. For example, maintaining product integrity during wiping tasks with paper toweling, providing hand protection during post urination cleanup for sanitary tissue, and providing protection against mucus for facial tissue. In other words, maintenance of as much as possible of the dry strength of a paper product after the paper product has become wetted with water or an aqueous solution is highly desirable.

A common measure of such dry strength maintenance is the ratio of initial wet strength ($W_i$) to dry strength (DS). As used herein, this ratio is identified as the wet to dry strength ratio. Wet strength and dry strength can be measured according to the methods described in the TEST METHODS section below. While the prior art has described paper products having a wet to dry strength ratio of about 0.2:1, or even somewhat higher, such products also have a dry strength that is great enough that the paper product would be undesirable for use as toweling, sanitary tissue or facial tissue because it was insufficiently soft. As is well known and will be discussed in the Softness Section below, there is a clear relationship between dry strength and perceived softness that says increasing dry strength decreases perceived softness. In other words, to date, the only way the art has been able to achieve substantial dry strength maintenance is by taking dry strength to levels which cause an unacceptable degradation in perceived softness for products such as toweling, sanitary tissue, and facial tissue. Typically, the art has been able to achieve wet to dry strength ratios on the order of 0.1:1 or, perhaps, 0.12:1 while, at the same time maintaining an acceptable level of softness.

On the other hand, the paper products of the present invention are able to achieve a wet to dry ratio of at least about 0.15:1 or, preferably, at least about 0.2:1 or, more preferably, 0.25:1. Without being bound by theory, the Applicants believe such ratios are achievable because the Applicants have identified certain furnish compositions, papermaking conditions, and finished paper composition that use the temporary wet strength resin, typically a component of low density tissue paper, to provide a greater portion of the dry strength. It is known that increasing the level of temporary wet strength resin also causes an increase in dry strength. However, in the past the art has considered this increase a limitation, if softness is to be maintained, rather than an opportunity. For example, the art, as in U.S. Pat. No. 3,755,220, issued to Freimark, et al. on Aug. 28, 1973, has provided chemical debonders to off-set this perceived undesirable dry strength so as to provide a softer, less harsh sheet of paper. The following details the specific furnish, papermaking, and paper composition parameters that the Applicant has identified as being of importance to achieving the present invention.

Temporary Wet Strength Resin

As noted above, the temporary wet strength resin not only provides temporary wet strength but also contributes to dry strength. A key element of the present invention is a substantial increase in the level of temporary wet strength resin. For example, a commercially successful sanitary tissue uses a temporary wet strength resin at a level of about 1 pound per ton (0.05%). In recognizing that the temporary wet strength resin can also provide the bulk of the dry strength for low density paper products prepared under the proper conditions, the Applicants have found that for the low density paper of the present invention the paper should comprise between about 4 pounds of temporary wet strength resin per ton of papermaking fibers (0.2%) and about 16 pounds per ton (0.8%). Preferably, the paper comprises between about 6 pounds per ton (0.3%) and about 12 pounds per ton (0.6%). In the particularly preferred layered paper products of the present invention the temporary wet strength resin is distributed between the inner layer and the outer layer such that the inner layer comprises between about 3 and 12 pounds per ton (0.15%–0.6%) and the outer layer comprises between about I and 4 pounds per ton (0.05%–0.2%). Preferably, the inner layer of the preferred layered paper products comprises between about 4 pounds per ton (0.2%) and about 8 pounds per ton (0.4%) and the outer layer comprises between about 2 pounds per ton (0.1%) and about 4 pounds per ton (0.2%). A particularly preferred layered paper product comprises about 8 pounds of temporary wet strength resin per ton of papermaking fibers (0.4%) in the inner layer and about 3 pounds per ton in the outer layers (0.15%). All percentages are based on the total weight of papermaking fibers (i.e. the combined weight of any short papermaking fibers and any long papermaking fibers that may be used).

Headbox pH

The Applicants have found that controlling headbox pH to be between about 4.5 and about 5.5, preferably between about 4.8 and about 5.4 contributes to an increased wet to dry strength ratio. Without being bound by theory, the Applicants believe that a more acid pH encourages more efficient crosslink formation by the temporary wet strength resin. While headbox pH for tissue products of the prior art may vary between about 4 and about 6 depending on the particular furnish composition, the art preferred to operate at a pH close to 6 due to a perceived increased risk of deposition of insoluble materials (stickies) onto the Fourdrinier wire as pH decreased. Stickies prevent proper formation by blocking portions of the Fourdrinier wire. However, as will be discussed in greater detail below, the Applicants have found that a sequential reduction in pH, combined with control of pH as discussed above, prevents undue formation of stickies when operating in a more acid range. Given this novel path to controlled pH, the Applicants have been able to achieve a papermaking process that produces low density tissue having a desirable wet to dry strength ratio.

Long Fiber Reduction

As is well known in the art, paper produced using longer papermaking fibers has a higher dry strength than paper produced using shorter fibers. For example, paper produced using Northern Sulfite Kraft (NSK) fibers has a greater dry strength than paper produced by shorter Eucalyptus fibers. Conversely, the paper produced using Eucalyptus fibers is softer than the paper produced using NSK fibers. Using layered structures, the art has taken advantage of these properties to produce paper structures having a center layer of longer fibers for dry strength and outer layers of shorter fibers for softness.

The Applicants have been able to take advantage of the contribution of the temporary wet strength resin to the dry strength of the low density paper by reducing the amount of long fiber in the paper structure. Specifically, paper structures according to the present invention having a papermaking fiber composition comprising between about 13% and about 25% long fibers have a desirable increase in wet to dry strength ratio. Preferably, the papermaking fiber composition comprises between about 14% and about 16% long fibers. More preferably, these long fibers are concentrated in the center layer of a three layered paper structure and the short fibers are concentrated in the outer layers of the structure.

Refining

The art also uses refining to increase the dry strength of paper products. As is known, refining is a mechanical process that fibrillates the papermaking fibers and encourages the formation of interfiber hydrogen bonds. One measure of refining is the Pulp filtration Resistance (PFR) test as is described in the TEST METHODS section below. Typically, the long papermaking fibers are refined to increase their dry strength contribution. Passing a typical long papermaking fiber, such as NSK, through a refining step typically causes a change in PFR of between about I second and about 3 seconds, more typically between about 2 and about 3 seconds. The low density tissue products of the present invention are able to achieve their desirable wet to dry strength ratios using substantially less refining. Suitably, the change in PFR for paper products of the present invention is between about 0.5 and about 1.5 seconds. Preferably, the change is between about 0.5 seconds and about 1 second.

Dry Strength Additive

As noted above, the art typically uses both a dry strength additive and one or more wet strength resins in producing tissue products. Perhaps, a debonding agent is also provided to overcome some of the negative softness effect of the dry strength additive. By taking advantage of the dry strength contribution of the temporary wet strength resin, the low density tissue products of the present invention substantially eliminate the need for adding a debonding agent to the furnish and substantially reduce the need for a dry strength additive. Suitably, the low density paper products of the present invention have a center layer comprising between about 0 and about 2 pounds of dry strength additive per ton of long papermaking fibers (0–0.1%). More preferably, the low density tissue products of the present invention comprise between 0 and about 1 pound per ton (0–0.05%). A particularly preferred low density tissue product of the present invention is dry strength additive free.

Wet Strength Decay

As used herein, the term "wet strength decay" is defined as the ratio of wet strength after thirty minutes ($W_{30}$) to initial wet strength ($W_i$). As noted above, wet strength decay is important so as to enable passage through sewer systems and septic tanks. In particular, wet strength decay allows such paper products to break up into small enough pieces that piping in such systems does not become clogged. It can be recognized that, the more quickly wet strength decays, the lower the risk of clogging. Typically, prior art paper products having temporary wet strength lose about thirty percent to one half of their initial wet strength after thirty minutes exposure to water. Certain high dry strength paper products lose as much as 80% of their initial wet strength ($W_{30}/W_i$~0.2). The paper products of the present invention lose at least about 60% ($W_{30}/W_i$<0.4), preferably at least about 70% of their initial wet strength ($W_{30}(W_i$<0.3).

As noted above, the low density tissue products of the present invention use an increased level of the temporary wet strength resin to provide both dry strength and temporary wet strength. As is known, temporary wet strength resins function by providing labile crosslinks between papermaking fibers. On exposure to water, these crosslinks begin to decay so there is a substantially reduced risk of problems on disposal of the tissue (eg sewer clogging). The Applicants have found that, as long as $W_{30}$ is less than about 35 grams per inch (14 grams/cm) disposal problems are minimized. Preferably $W_{30}$ is less than 30 grams per inch (12 grams/cm). The Applicants believe that the low density tissue products of the present invention are able to achieve such acceptable levels of decay, even though they have substantially increased initial wet strengths, because wet strength decays at a relatively constant rate versus time. That is, after a given time, wet strength will decay by a given percentage so, while the higher initial wet strengths decay to a higher absolute value of $W_{30}$, this value is still sufficiently low so as not to pose a substantial risk of disposal problems.

Softness

The paper products according to the present invention are desirably soft. In particular, the paper products of the present invention ) have softness that is at least comparable to prior art paper products. As used herein, softness of one paper product is at least comparable to the softness of another paper product if the relative softness value when the two products are compared according to the Panel Softness Method described in the TEST METHODS section is greater than about −0.2PSU. To achieve this desirable softness the Applicants have looked at several of the contributors to softness and defined product and process conditions so as to provide such softness along with the other aspects of the present invention. Such contributors are discussed individually below.

Dry Strength

As noted above, there is an inverse relationship between softness and dry strength. Softness is typically measured by comparing a test paper to a control paper. A method for conducting such measurements is described in the TEST METHODS section below. For paper products having utility as toweling, sanitary tissue, or facial tissue softness is highly desirable. Given the relationship between softness and dry strength, such desired softness effectively places an upper limit on dry strength. The Applicants have found that paper products having a total dry tensile strength of less than about 500 grams per inch (197 grams per centimeter) have softness that is at least comparable to prior art paper products. Preferably the total dry tensile strength is less than about 450 grams per inch (177 grams per centimeter), more preferably less than about 425 grams per inch (167 grams per centimeter), still more preferably, less than about 375 grams per inch (148 grams per centimeter).

The art has used various means to achieve dry strength. Exemplary means include: refining whereby the surface area of the papermaking fibers is increased by fibrillation so as to increase hydrogen bonding between the papermaking fibers; the aforementioned dry strength additives; and the dry strength contribution of any wet strength resins (either permanent wet strength resins or temporary wet strength resins) that may be provided. As noted above, the Applicants have found that desirable levels of dry strength can be achieved for the paper products of the present invention, while minimizing the use of extraneous means, such as refining or a specially added dry strength additive. Without being bound by theory, the Applicants believe that, this achievement of a desirable level of dry strength is due to a more efficient use of the temporary wet strength resin. That is, a contribution of interfiber hydrogen bonding and the temporary wet strength resin of the present invention provides sufficient dry strength to meet the process and performance needs of the paper product without being so great so as to cause a negative softness profile.

Modulus

As is well known, stiffer products are perceived as being less soft. One measure of stiffness is modulus (i.e. the slope of a stress/strain curve). A method for measuring modulus is provided in the TEST METHODS section below. The Applicants believe that one reason that softness of the present invention is at least comparable to the to the softness of the prior art, while providing higher temporary wet strength, is that the low density paper of the present invention has a modulus that is comparable to, preferably lower than, the modulus of low density paper of the prior art. Low density tissue paper having a modulus less than about 12 grams/cm% has satisfactory softness. Preferably, the modulus is less than about 10 grams/cm%. A particularly preferred embodiment of the present invention has a modulus between about 6 grams/cm% and about 10 grams/cm%.

A particularly preferred low modulus tissue paper is pattern densified tissue paper. Pattern densified tissue paper is characterized by having a relatively high bulk field of relatively low fiber density and an array of densified zones of relatively high fiber density. The high bulk field is alternatively characterized as a field of pillow regions. The densified zones are alternatively referred to as knuckle regions. The densified zones may be discretely spaced within the high bulk field or may be interconnected, either fully or partially, within the high bulk field. Because of their lower density, the pillow regions provide regions are believed to provide relatively higher stretch causing pattern densified tissue to have an overall lower modulus than a web having a substantially uniform density.

Preferred processes for making pattern densified tissue webs are disclosed in U.S. Pat. No. 3,301,746, issued to Sanford and Sisson on Jan. 31, 1967, U.S. Pat. No. 3,974,025, issued to Peter G. Ayers on Aug. 10, 1976, and U.S. Pat. No. 4,191,609, issued to Paul D. Trokhan on Mar. 4, 1980, and U.S. Pat. No. 4,637,859, and issued to Paul D. Trokhan on Jan. 20, 1987, all of which are incorporated herein by reference.

In general, pattern densified webs are preferably prepared by depositing a paper making furnish on a foraminous forming wire such as a Fourdrinier wire to form a wet web and then juxtaposing the web against an array of supports. The web is pressed against the array of supports, thereby resulting in densified zones in the web at the locations geographically corresponding to the points of contact between the array of supports and the wet web. The remainder of the web not compressed during this operation is referred to as the high bulk field. The web is dewatered, and optionally predried, in such a manner so as to substantially avoid compression of the high bulk field. This is preferably accomplished by fluid pressure, such as with a vacuum type device or blow-through dryer, or alternately by mechanically pressing the web against an array of supports wherein the high bulk field is not compressed. The operations of dewatering, optional predrying and formation of the densified zones may be integrated or partially integrated to reduce the total number of processing steps performed. Subsequent to formation of the densified zones, dewatering, and optional predrying, the web is dried to completion, preferably still avoiding mechanical pressing. Preferably, from about 8% to about 55% of the multi-layered tissue paper surface comprises densified knuckles having a relative density of at least 125% of the density of the high bulk field.

The array of supports is preferably an imprinting carrier fabric having a patterned displacement of knuckles which operate as the array of supports which facilitate the formation of the densified zones upon application of pressure. The pattern of knuckles constitutes the array of supports previously referred to. Imprinting carrier fabrics are disclosed in U.S. Pat. No. 3,301,746, Sanford and Sisson, issued Jan. 31, 1967, U.S. Pat. No. 3,821,068, Salvucci, Jr. et al., issued May 21, 1974, U.S. Pat. No. 3,974,025, Ayers, issued Aug. 10, 1976, U.S. Pat. No. 3,573,164, Friedberg et al., issued Mar. 30, 1971, U.S. Pat. No. 3,473,576, Amneus, issued Oct. 21, 1969, U.S. Pat. No. 4,239,065, Trokhan, issued Dec. 16, 1980, and U.S. Pat. No. 4,528,239, Trokhan, issued Jul. 9, 1985, all of which are incorporated herein by reference.

A particularly preferred pattern densified, low density tissue according to the present invention is made according to the aforementioned U.S. Pat. No. 4,637,859 using a deflection member as described in the aforementioned U.S. Pat. No. 4,528,239. Such paper has an interconnected pattern of higher density corresponding to the knuckles of the deflection member. The densified zones surround and isolate a plurality of lower density pillows which are distributed in a non-random repeating pattern. That is, each pillow is in the form of a closed figure having a shape (in plan view) which includes, but is not limited to, circles, ovals, polygons of six and fewer sides, bow tie shaped figures, and weave-like patterns, bow tie shaped figures being particularly preferred. Such patterns are discussed in greater detail in U.S. Pat. No. 5,679,222, issued in the name of Rasch, et al. on Oct. 21, 1997, the disclosure of which is incorporated herein by reference.

As is also discussed in the aforementioned U.S. Pat. No. 5,679,222, overburden can significantly affect the properties of any paper made using the belt. Such properties include: degree of pinholing, caliper generation, and modulus. In addition to the teachings of U.S. Pat. No. 5,679,222, the Applicants have found that an overburden between about 2.0 mils (0.05 mm) and about 8 mils (0.2 mm) provides an acceptable balance between caliper generation, modulus, and prevention of pinholing. A particularly preferred overburden is between about 5.5 mils (0.14 mm) and about 6.5 mils (0.17 mm). As noted above, the Applicants believe that the pillow regions provide relatively higher stretch resulting in an overall lower modulus for pattern densified tissue when compared to a non-pattern densified tissue having a comparable basis weight.

Wet Burst Strength

The combination of improved temporary wet strength and lower modulus combine to provide improved temporary wet burst strength when compared to low density tissue products of the prior art. Wet burst strength is particularly important for sanitary tissue products because it is a measure of the protection such products provide during use ("poke through" resistance). That is, paper products having insufficient wet burst strength are seen as being very undesirable. The low density tissue products of the present invention have an initial wet burst strength of at least about 35 grams, preferably the wet burst strength is between about 35 grams and about 70 grams. More, preferably, the wet burst strength is between about 45 grams and about 60 grams. A method for measuring wet burst strength is given in the TEST METHODS section below.

Lint Resistance

Lint resistance is an important property for many of the uses of low density tissue products. For example, sanitary tissue products with a propensity to lint can cause dusting as such a product is unrolled and high Tinting facial tissue products can leave unsightly lint on surfaces (eg glasses) after wiping. The Applicants have found that, when a paper product has a lint value of less than about 8 when measured according to the Lint Test described in the TEST METHODS section, negative linting comments are substantially reduced. Preferably, the lint value is less than about 7.

The low density tissue products of the present invention have such desirable low lint values because of the increased level of the temporary wet strength resin. For example, by providing the particularly preferred layered products of the present invention with a low level of a temporary wet strength resin (typically strength additives are not provided to the outer layers of low density tissue products because of reductions in softness), lint resistance is substantially increased.

Composition of the Paper Product

Papermaking Fibers

It is anticipated that wood pulp in all its varieties will normally comprise the papermaking fibers used in this invention. However, other cellulose fibrous pulps, such as cotton liners, bagasse, rayon, etc., can be used and none are disclaimed. Wood pulps useful herein include chemical pulps such as Kraft, sulfite and sulfate pulps as well as mechanical pulps including for example, ground wood, thermomechanical pulps and Chemi-ThermoMechanical Pulp (CTMP). Pulps derived from both deciduous and coniferous trees can be used.

Synthetic fibers such as rayon, polyethylene and polypropylene fibers, may also be utilized in combination with the above-identified natural cellulose fibers. One exemplary polyethylene fiber which may be utilized is Pulpex®, available from Hercules, Inc. (Willington, Del.).

Both hardwood pulps and softwood pulps as well as blends of the two may be employed. The terms hardwood pulps as used herein refers to fibrous pulp derived from the woody substance of deciduous trees (angiosperms): wherein softwood pulps are fibrous pulps derived from the woody substance of coniferous trees (gymnosperns). Hardwood pulps such as eucalyptus are particularly suitable for the outer layers of the multi-layered tissue webs described hereinafter, whereas northern softwood Kraft (NSK) pulps are preferred for the inner layer(s) or ply(s). Also applicable to the present invention are low cost fibers derived from recycled paper, which may contain any or all of the above categories as well as other non-fibrous materials such as fillers and adhesives used to facilitate the original paper making.

Temporary Wet Strength Resin

The paper products of the present invention also contain as an essential ingredient a temporary wet strength resin.

Preferably, the temporary wet strength resin is a cationic, polyaldehyde polymer having free aldehyde groups. By "free aldehyde groups" it is meant that the aldehyde groups are not bonded to other functional groups which would render them unreactive with the cellulosic fibers. For example, an aldehyde group may form interfiber chemical bonds, typically covalent bonds, with a cellulosic hydroxyl group when the paper product is dried (chemical bonds joining different cellulosic fibers are formed). Preferred polyaldehydes are those which impart a temporary, rather than permanent, wet strength to paper products when they are incorporated as a sole strength additive in comparable paper products.

Preferred polyaldehydes are water soluble in order to facilitate a water based process. As used herein, "water soluble" includes the ability of a material to be dissolved, dispersed, swollen, hydrated or similarly admixed in water. Similarly, as used herein, reference to the phrase "substantially dissolved," "substantially dissolving" and the like refers to the dissolution, dispersion, swelling, hydration and the like admixture of a material in a liquid medium (e.g., water). The mixture typically forms a generally uniform liquid mixture having, to the naked eye, one physical phase.

Suitable polyaldehyde polymers include natural and synthetic polymers prepared or modified to contain aldehyde groups. Suitable polyaldehyde polymers include, but are not limited to, aldehyde modified starches and polyacrylamides, and acrolein copolymers.

The polyaldehyde polymer may be electronically neutral or charged, e.g., an ionic polymer such as anionic or cationic polyaldehyde polymers. Cationic polyaldehyde polymers are preferred. Without intending to be limited or bound by theory, it is believed that the cationic polyaldehyde tends to be retained on the cellulosic fibers, which are anionic in nature. Exemplary cationic polyaldehyde polymers include cationic, aldehyde functionalized starches and cationic, aldehyde functionalized polyacrylamides, the polyacrylamides being preferred. Cationic, aldehyde-functionalized starches suitable for use herein include that which is commercially available from National Starch & Chemical Co. of Bloomfield, N.J. under the trademark COBOND 1000. Cationic, aldehyde-functionalized polyacrylamides suitable for use herein include those commercially available from Cytec Industries Inc. of West Patterson, N.J. under the trademark PAREZ. Suitable resins of this type include: 631 N.C. and PAREZ 750A. Particularly preferred cationic, aldehyde-functionalized polyacrylarmides are: PAREZ 750B and PAREZ EXPN 3683.

Aldehyde-functionalized polymers suitable for use herein also include other temporary wet strength resins described in U.S. Pat. No. 4,954,538, Dauplaise et al., issued Sep. 1990; U.S. Pat. No. 4,981,557, Bjorkquist, issued Jan. 1, 1991; and U.S. Pat. No. 5,320,711, Dauplaise, et al., issued Jun. 14, 1994; U.S. Pat. No. 5,723,022, Dauplaise, et al., issued Mar. 3, 1998; the disclosure of each of which is incorporated herein by reference.

The Papermaking Process

Figure 2:
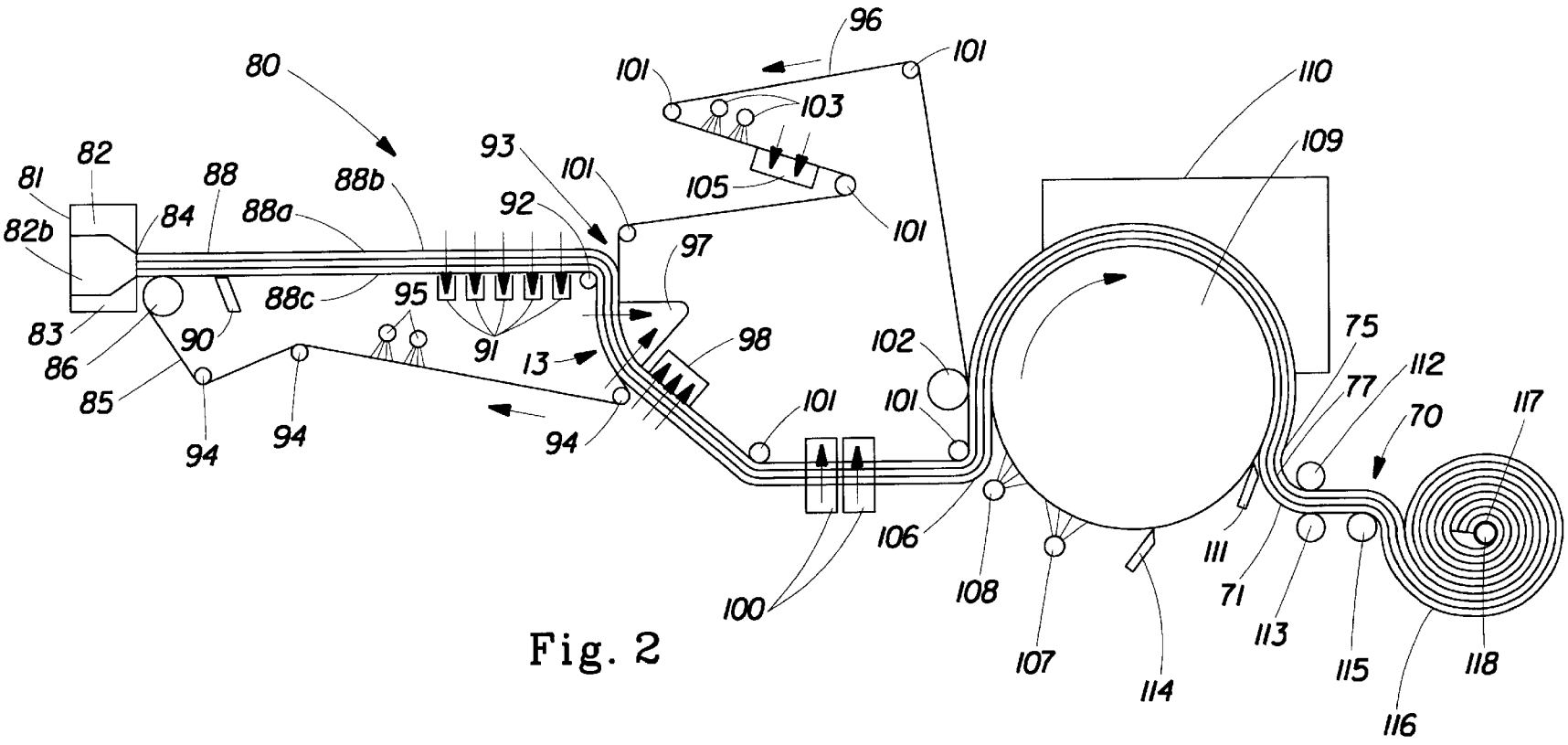
FIG. 2 is a schematic representation illustrating a papermaking process for producing the paper product of the present invention wherein the product is creped after drying.
Figure 3:
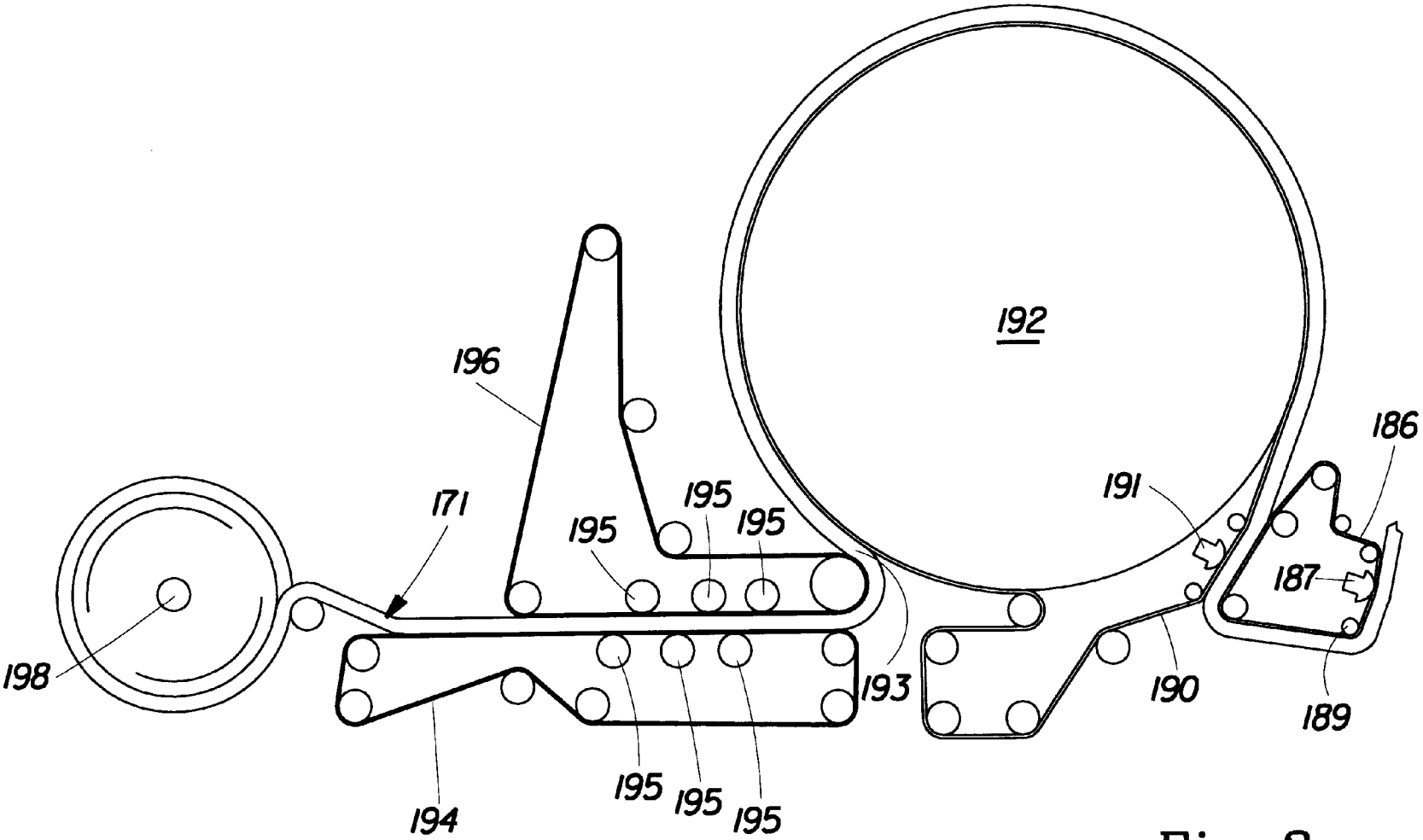
FIG. 3 is a schematic representation of an alternative drying process wherein the paper product is uncreped.

FIGS. 1–3 are schematic representations of various portions of papermaking processes incorporating the preferred embodiments of the present invention. These preferred embodiments are described in the following discussion, wherein reference is made to FIG. 1 which is a schematic representation illustrating the steps for preparing an aqueous papermaking furnish for a papermaking process suitable for producing the paper product of the present and FIGS. 2 and 3 are side elevational views of papermachines suitable for producing the low density tissue of the present invention.

The papermaking process begins with the preparation of the one or more papermaking furnishes. Depending on the desired structure of the finished paper product and the design of a particular papermachine, one or more furnishes is prepared. For homogeneous paper structures only one furnish is necessary. For layered structures two or more furnishes are necessary. Referring to FIG. 1, a process for preparing the furnishes necessary to produce the paper according to the present invention having a particularly preferred layered structure is described hereinafter.

Referring to FIG. 2, which is a side elevational view of a preferred papermachine 80 for manufacturing paper according to the present invention, the furnishes) is (are) delivered to the papermachine 80. Papermachines producing homogeneous paper structures may have one or more chambers 82–83. (One of skill in the art will recognize that the same furnish can be directed to more than one chamber). Papermachines producing layered structures require at least two chambers 82–83. Such layered papermachines 80 comprise, for example, a layered headbox 81 having a top chamber 82 a center chamber 82*b,* and a bottom chamber 83, a slice roof 84, and a Fourdrinier wire 85 which is looped over and about breast roll 86, deflector 90, vacuum suction boxes 91, couch roll 92, and a plurality of turning rolls 94.

While the paper product of the present invention can have either a homogeneous or a layered structure, a particularly preferred embodiment is multi-layered with three layers. The two outer layers are produced by a first furnish 22 pumped to chambers 82 and 83 as shown in FIG. 2 and the center layer is produced by a second furnish 21 pumped to center chamber 82*b.* The following discusses a particularly preferred composition for each of the furnishes.

Still referring to FIG. I a storage vessel I is provided for staging an aqueous slurry of relatively long papermaking fibers. The slurry is made up by dispersing the fibers in water using a conventional repulper (not shown). A caustic solution (e. g. sodium hydroxide in water) may also be added during repulping to adjust the pH of the slurry so it is between about 5.0 and about 6.5 as it enters pump 2. The slurry is conveyed by pump 2 and, optionally, through refiner 3 to mixer 4 (provided for the optional addition of other sources of fiber, such as broke). First long fiber additive pipe 5 is provided to add an acid solution to initially condition the pH of the furnish toward the desired range. Second long fiber additive pipe 6 is provided to introduce a water solution of a temporary wet strength resin to the papermaking fiber slurry. Pump 7 mixes the papermaking fiber slurry, the acid, and the temporary wet strength resin. The slurry pH after mixing is controlled to be between about 4.8 and about 5.4. Pump 7 also conveys the initially conditioned, resin treated long papermaking fiber slurry toward third long fiber additive pipe 8 where a second portion of acid is added to control the pH of the slurry, compensating for whitewater alkalinity. Fan pump 10 mixes the slurry and the additional acid with diluting whitewater from pipe 9. The fully conditioned slurry 21 (pH remains between about 4.8 and about 5.4) is then conveyed to the middle chamber 82*b* of beadbox 81 (shown in FIG. 2).

Still referring to FIG. 1, a storage vessel 11 is provided for a slurry of short papermaking fibers. The slurry is made up by dispersing the short papermaking fibers in water using a conventional repulper (not shown). A caustic solution (e. g. sodium hydroxide in water) may also be added during repulping to adjust the pH of the slurry so it is between about 5.0 and about 6.5 as it enters pump 12. The slurry is conveyed by pump 12 to mixer 14 (provided for the optional addition of other sources of fiber, such as broke). First short fiber additive pipe 15 is provided to add acid to initially condition the pH of the furnish toward the desired range. Second short fiber additive pipe 16 is provided to introduce a water solution of a temporary wet strength resin to the papermaking fiber slurry. Pump 17 mixes the papermaking fiber slurry, the acid, and the temporary wet strength resin. The slurry pH after mixing is controlled to be between about 4.8 and about 5.4. Pump 17 also conveys the initially conditioned, resin treated short papermaking fiber slurry toward third short fiber additive pipe 18 where a second portion of acid is added to control the pH of the slurry, compensating for whitewater alkalinity. Fan pump 20 mixes the slurry and the additional acid with diluting whitewater from pipe 19. The fully conditioned slurry 22 (pH remains between about 4.8 and about 5.4) is then divided into two portions one of which is conveyed to top chamber 82 of headbox 81 and the other of which is conveyed to bottom chamber 83 of headbox 81 (as shown in FIG. 2).

Again referring to FIG. 2, the first papermaking furnish 22 is pumped through top chamber 82 and bottom chamber 83 and the second papermaking furnish 21 is pumped through center chamber 82*b* and thence out of the slice roof 84 in over and under relation onto Fourdrinier wire 85 to form thereon an embryonic web 88 comprising layers 88*a,* and 88*b,* and 88*c*. Dewatering occurs through the Fourdrinier wire 85 and is assisted by deflector 90 and vacuum boxes 91. As the Fourdrinier wire makes its return run in the direction shown by the arrow, showers 95 clean it prior to its commencing another pass over breast roll 86. At web transfer zone 93, the embryonic web 88 is transferred to a foraminous carrier fabric 96 by the action of vacuum transfer box 97. Carrier fabric 96 carries the web from the transfer zone 93 past vacuum dewatering box 98, through blow-through predryers 100 and past two turning rolls 101, forming semi-dry embryonic tissue paper web, 106, still supported by the foraminous carrier fabric, 96.

The semi-dry tissue paper web is secured to the cylindrical surface of Yankee dryer 109 aided by adhesive applied by spray boom 107 and 108. Adhesion of the web is promoted by use of the opposing cylindrical steel drum, 102. Drying is completed on the steam heated Yankee dryer 109 and by hot air which is heated and circulated through drying hood 110 by means not shown. The web is then dry creped from the Yankee dryer 109 by doctor blade 111, also-called a creping blade, after which it is designated paper sheet 70 comprising a Yankee-side layer 71 a center layer 77, and an off-Yankee-side layer 75. Paper sheet 70 then passes between calender rolls 112 and 113, about a circumferential portion of reel 115, and thence is wound into a roll 116 on a core 117 disposed on shaft 118.

After the web is transferred to Yankee dryer 109, the carrier fabric 96 is then cleaned and dewatered as it completes its loop by passing over and around additional turning rolls 101, showers 103, and vacuum dewatering box 105.

In an alternative drying scheme, shown in FIG. 3, the embryonic web 88 supported by Fourdrinier wire 85 is transferred to a foraminous transfer (i.e. carrier) fabric 186 by the action of vacuum transfer box 187 and turning roll 189. Carrier fabric 186 travels at a slower speed than Fourdrinier wire 85. The purpose of carrier fabric 186 is therefore to shorten the embryonic web 88 relative to its length while being supported on Fourdrinier wire 85. A further purpose of carrier fabric 186 is to transport the embryonic web to a blow through dryer fabric 190. During this travel, the embryonic web can optionally be further dewatered by means of vacuum boxes not shown. The path of carrier fabric 186 is controlled by a plurality of turning rolls shown but not numbered for simplicity. The transfer to the blow through dryer fabric 190 is effected by means of a vacuum box 191. Carrier fabric 186 is preferably showered by means not shown prior to its return to the web transfer zone promoted by vacuum box 187. After transfer to the blow through dryer fabric 190, the wet web is transported through blow through dryer 192, whereupon, hot air generated by means not shown is propelled through the dryer fabric and consequently the embryonic web which resides thereupon. The dried web 193 is dislodged from the dryer fabric 190 at the exit of the predryer. At this point, dried web 193 can optionally be directed between two, relatively smooth, dry end carrying fabrics, an upper fabric 196 and a lower fabric 194. While secured between fabrics 196 and 194, the dried web 193 can be calendered by a series of fixed gap calendering nips formed between opposing pairs of rollers 195. These nips smooth the surface and control the thickness of the tissue paper. Still referring to FIG. 3, the finished calendered web 171 emerges from the space between opposing carrier fabrics 196 and 194 still supported by carrier fabric 94 after which it is wound upon reel 198.

The present invention is particularly adapted for paper products which are to be disposed into sewer systems, such as toilet tissue. However, it is to be understood that the present invention is applicable to a variety of paper products including, but not limited to disposable absorbent paper products such as those used for household, body, or other cleaning applications and those used for the absorption of body fluids such as urine and menses. Exemplary paper products thus include tissue paper including toilet tissue and facial tissue, paper towels, absorbent materials for diapers, feminine hygiene articles including sanitary napkins, pantiliners and tampons, adult incontinent articles and the like, and writing paper.

Tissue paper of the present invention can be homogeneous or multi-layered construction; and tissue paper products made therefrom can be of a single-ply or multi-ply construction. The tissue paper preferably has a basis weight of between about 10 $g/m^2$ and about 65 $g/m^2$, and density of about 0.6 $g/cm^3$ or less. More preferably, the basis weight will be about 40 $g/m^2$ or less and the density will be about 0.3 $g/cm^3$ or less. Most preferably, the density will be between about 0.04 $g/cm^3$ and about 0.2 $g/cm^3$. See Column 13, lines 61–67, of U.S. Pat. No. 5,059,282 (Ampulski et al), issued Oct. 22, 1991, which describes how the density of tissue paper is measured. (Unless otherwise specified, all amounts and weights relative to the paper are on a dry basis.) The tissue paper may be pattern densified tissue paper, and uncompacted, nonpattern-densified tissue paper. These types of tissue paper and methods for making such paper are well known in the art and are described, for example, in U.S. Pat. No. 5,334,286, issued on Aug. 2, 1994 in the names of Dean V. Phan and Paul D. Trokhan, incorporated herein by reference in its entirety.

TEST METHODS

A. Strength Tests

The paper products are aged prior to tensile testing a minimum of 24 hours in a conditioned room where the temperature is 73° F.±4° F. (22.8° C.±2.2° C.) and the relative humidity is 50%±10%.

1. Total Dry Tensile Strength (DS)

This test is performed on one inch by five inch (about 2.5 cm×12.7 cm) strips of paper (including handsheets as described below, as well as other paper sheets) in a conditioned room where the temperature is 73° F.±4° F. (about 28°

C.±2.2° C.) and the relative humidity is 50%±10%. An electronic tensile tester (Model 1122, Instron Corp., Canton, Mass.) is used and operated at a crosshead speed of 2.0 inches per minute (about 5.1 cm per min.) and a gauge length of 4.0 inches (about 10.2 cm). Reference to a machine direction means that the sample being tested is prepared such that the 5" dimension corresponds to that direction. Thus, for a machine direction (MD) DS, the strips are cut such that the 5" dimension is parallel to the machine direction of manufacture of the paper product. For a cross machine direction (CD) DS, the strips are cut such that the 5" dimension is parallel to the cross-machine direction of manufacture of the paper product. Machine-direction and cross-machine directions of manufacture are well known terms in the art of paper-making.

The MD and CD tensile strengths are determined using the above equipment and calculations in the conventional manner. The reported value is the arithmetic average of at least six strips tested for each directional strength. The DS is the arithmetic total of the MD and CD tensile strengths.

2. Wet Tensile

An electronic tensile tester (Model 1122, Instron Corp.) is used and operated at a crosshead speed of 1.0 inch (about 2.5 cm) per minute and a gauge length of 1.0 inch (about 2.5 cm), using the same size strips as for DS. The two ends of the strip are placed in the upper jaws of the machine, and the center of the strip is placed around a stainless steel peg. The strip is soaked in distilled water at about 20° C. for the desired soak time, and then measured for tensile strength. One half the measured wet tensile is taken as the single strip wet strength. As in the case of the DS, reference to a machine direction means that the sample being tested is prepared such that the 5' dimension corresponds to that direction. The MD and CD wet tensile strengths are determined using the above equipment and calculations in the conventional manner. The reported value is the arithmetic average of at least six strips tested for each directional strength. The total wet tensile strength for a given soak time is the arithmetic total of the MD and CD tensile strengths for that soak time. Initial total wet tensile strength ($W_i$) is measured when the paper has been saturated for 5±0.5 seconds. 30 minute total wet tensile ($W_{30}$) is measured when the paper has been saturated for 30±0.5 minutes.

3. Tensile Modulus

Tensile Modulus of tissue samples is obtained at the same time as the tensile strength of the sample is determined. In this method a single ply 10.16 cm wide sample is placed in a tensile tester (Thwing Albert QCII interfaced to an LMS data system) with a gauge length of 5.08 cm. The sample is elongated at a rate of 2.54 cm/minute. The sample elongation is recorded when the load reaches 10 g/cm (F10), 15 g/cm (F15), and 20 g/cm ($F_{20}$). A tangent slope is then calculated with the mid-point being the elongation at 15 g/cm (F15).

The Tangent slope is calculated in the following manner:

$$\text{Tangent slope (TenMod15)} = (\text{delta force})/(\text{delta elongation}) = \frac{(F20 - F10)}{(\%\,\text{elongation@}\,F20 - \%\text{elongation@}\,F10)}$$

Another exemplary method for obtaining the tangent slope at 15 g/cm is to use a Thwing-Albert STD tensile tester and set the load trap to 152.4 grams in the tangent slope calculation program. This is equivalent to 15 g/cm when using the 10.16 cm width sample.

Total Tensile Modulus is obtained by measuring the Tensile Modulus in the machine direction at 15 glcm and cross machine direction at 15 g/cm and then calculating the geometric mean. Mathematically, this is the square root of the product of the machine direction Tensile Modulus (TenMod15MD) and the cross direction Tensile Modulus (TenMod15CD).

$$\text{TotalTensileModulus} = \sqrt{\text{TenMod15AfD} \times \text{TenMod15CD}}$$

High values for Total Tensile Modulus indicate that the sample is stiff and rigid.

4. Burst Strength

Overview

The test specimen, held between annular clamps, is subjected to increasing force that is applied by a 0.625 inch diameter, polished stainless steel ball. The burst strength is that force that causes the sample to fail. Burst strength may be measured on wet or dry samples.

Apparatus

Burst Tester Intelect-II-STD Tensile Test Instrument, Cat. No. 1451-24PGB or the Thwing-Albert Burst Tester are both suitable. Both instruments are available from Thwing-Albert Instrument Co., Philadelphia, Pa. The instruments must be equipped with a 2000 g load cell and, if wet burst measurements are to be made, the instruments must be equipped with a load cell shield and a front panel water shield.

Conditioned Room Temperature and humidity should be controlled to remain within the following limits:

Temperature: 73±3° F. (23° C.±2° C.)

Humidity: 50±2% Relative Humidity

Paper Cutter Scissors or other equivalent may be used

Pan For soaking wet burst samples, suitable to sample size

Solution Water for soaking wet burst samples should be equilibrated to the temperature of the conditioned room.

Timer Appropriate for measuring soak time

Sample preparation

1) Cut the sample to a size appropriate for testing (minimum sample size 4.5 in×4.5 in). Prepare a minimum of five samples for each condition to be tested.
2) If wet burst measurements are to be made, place an appropriate number of cut samples into a pan filled with temperature-equilibrated Equipment Setup 1) Set the burst tester up according to the manufacturer's instructions. If an Intelect-II-STD Tensile Test Instrument is to be used the following are appropriate: Speed: 12.7 centimeters per minute Break Sensitivity: 20 grams Peak Load: 2000 grams
2) Calibrate the load cell according to the expected burst strength.

Measurement and Reporting

1) Operate the burst tester according to the manufacturer's instructions to obtain a burst strength measurement for each sample.
2) Record the burst strength for each sample and calculate an average and a standard deviation for the burst strength for each condition.
3) Report the average and standard deviation for each condition to the nearest gram.

B. Density

The density of multi-layered tissue paper, as that term is used herein, is the average density calculated as the basis weight of that paper divided by the caliper, with the appropriate unit conversions incorporated therein. Caliper of the multi-layered tissue paper, as used herein, is the thickness of the paper when subjected to a compressive load of 95 g/in$^2$ (15.5 g/cm$^2$).

C. Measurement of Panel Softness of Tissue Papers

Ideally, prior to softness testing, the paper samples to be tested should be conditioned according to TAPPI Method #T4020M-88. Here, samples are preconditioned for 24 hours at a relative humidity level of 10 to 35% and within a temperature range of 22 to 40° C. After this preconditioning step, samples should be conditioned for 24 hours at a relative humidity of 48 to 52% and within a temperature range of 22 to 24° C.

Ideally, the softness panel testing should take place within the confines of a constant temperature and humidity room. If this is not feasible, all samples, including the controls, should experience identical environmental exposure conditions.

Softness testing is performed as a paired comparison in a form similar to that described in "Manual on Sensory Testing Methods", ASTM Special Technical Publication 434, published by the American Society For Testing and Materials 1968 and is incorporated herein by reference. Softness is evaluated by subjective testing using what is referred to as a Paired Difference Test. The method employs a standard external to the test material itself. For tactile perceived softness two samples are presented such that the subject cannot see the samples, and the subject is required to choose one of them on the basis of tactile softness. The result of the test is reported in what is referred to as Panel Score Unit (PSU). With respect to softness testing to obtain the softness data reported herein in PSU, a number of softness panel tests are performed. In each test ten practiced softness judges are asked to rate the relative softness of three sets of paired samples. The pairs of samples are judged one pair at a time by each judge one sample of each pair being designated X and the other Y. Briefly, each X sample is graded against its paired Y sample as follows:

1. a grade of plus one is given if X is judged to may be a little softer than Y, and a grade of minus one is given if Y is judged to may be a little softer than X;
2. a grade of plus two is given if X is judged to surely be a little softer than Y, and a grade of minus two is given if Y is judged to surely be a little softer than X;
3. a grade of plus three is given to X if it is judged to be a lot softer than Y, and a grade of minus three is given if Y is judged to be a lot softer than X; and, lastly:
4. a grade of plus four is given to X if it is judged to be a whole lot softer than Y, and a grade of minus 4 is given if Y is judged to be a whole lot softer than X.

The grades are averaged and the resultant value is in units of PSU. The resulting data are considered the results of one panel test. If more than one sample pair is evaluated then all sample pairs are rank ordered according to their grades by paired statistical analysis. Then, the rank is shifted up or down in value as required to give a zero PSU value to which ever sample is chosen to be the zero-base standard. The other samples then have plus or minus values as determined by their relative grades with respect to the zero base standard. The number of panel tests performed and averaged is such that about 0.2 PSU represents a significant difference in subjectively perceived softness.

D. Measurement of Tissue Paper Lint

The amount of lint generated from a tissue product is determined with a Sutherland Rub Tester. This tester uses a motor to rub a weighted felt 5 times over the stationary toilet tissue. The Hunter Color L value is measured before and after the rub test. The difference between these two Hunter Color L values is calculated as lint.

Sample Preparation:

Prior to the lint rub testing, the paper samples to be tested should be conditioned according to TAPPI Method #T4020M-88. Here, samples are preconditioned for 24 hours at a relative humidity level of 10 to 35% and within a temperature range of 22 to 40 ° C. After this preconditioning step, samples should be conditioned for 24 hours at a relative humidity of 48 to 52% and within a temperature range of 22 to 24° C. This rub testing should also take place within the confines of the constant temperature and humidity room.

The Sutherland Rub Tester may be obtained from Testing Machines, Inc. (Amityville, N.Y., 11701). The tissue is first prepared by removing and discarding any product which might have been abraded in handling, e.g. on the outside of the roll. For multi-ply finished product, three sections with each containing two sheets of multi-ply product are removed and set on the bench-top. For single-ply product, six sections with each containing two sheets of single-ply product are removed and set on the bench-top. Each sample is then folded in half such that the crease is running along the cross direction (CD) of the tissue sample. For the multi-ply product, make sure one of the sides facing out is the same side facing out after the sample is folded. In other words, do not tear the plies apart from one another and rub test the sides facing one another on the inside of the product. For the single-ply product, make up 3 samples with the wire side out and 3 with the non-wire side out. Keep track of which samples are wire side out and which are non-wire side out.

Obtain a 30"×40" piece of Crescent #300 cardboard from Cordage Inc. (800 E. Ross Road, Cincinnati, Ohio, 45217). Using a paper cutter, cut out six pieces of cardboard of dimensions of 2.5"×6". Puncture two holes into each of the six cards by forcing the cardboard onto the hold down pins of the Sutherland Rub tester.

If working with single-ply finished product, center and carefully place each of the 2.5"×6" cardboard pieces on top of the six previously folded samples. Make sure the 6" dimension of the cardboard is running parallel to the machine direction (MD) of each of the tissue samples. If working with multi-ply finished product, only three pieces of the 2.5"×6" cardboard will be required. Center and carefully place each of the cardboard pieces on top of the three previously folded samples. Once again, make sure the 6" dimension of the cardboard is running parallel to the machine direction (MD) of each of the tissue samples.

Fold one edge of the exposed portion of tissue sample onto the back of the cardboard. Secure this edge to the cardboard with adhesive tape obtained from 3M Inc. (¾" wide Scotch Brand, St. Paul, Minn.). Carefully grasp the other over-hanging tissue edge and snugly fold it over onto the back of the cardboard. While maintaining a snug fit of the paper onto the board, tape this second edge to the back of the cardboard. Repeat this procedure for each sample.

Turn over each sample and tape the cross direction edge of the tissue paper to the cardboard. One half of the adhesive tape should contact the tissue paper while the other half is adhering to the cardboard. Repeat this procedure for each of the samples. If the tissue sample breaks, tears, or becomes frayed at any time during the course of this sample preparation procedure, discard and make up a new sample with a new tissue sample strip.

If working with multi-ply converted product, there will now be 3 samples on the cardboard. For single-ply finished product, there will now be 3 wire side out samples on cardboard and 3 non-wire side out samples on cardboard.

Felt Preparation Obtain a 30"×40" piece of Crescent #300 cardboard from Cordage Inc. (800 E. Ross is Road, Cincinnati, Ohio, 45217). Using a paper cutter, cut out six pieces of cardboard of dimensions of 2.25"×7.25". Draw two lines parallel to the short dimension and down 1.125" from the top and bottom most edges on the white side of the cardboard. Carefully score the length of the line with a razor blade using a straight edge as a guide. Score it to a depth about half way through the thickness of the sheet. This scoring allows the cardboard/felt combination to fit tightly around the weight of the Sutherland Rub tester. Draw an arrow running parallel to the long dimension of the cardboard on this scored side of the cardboard.

Cut the six pieces of black felt (F-55 or equivalent having a coefficient of friction between 0.5 and 0.58 against low density tissue paper. Suitable felt is available from New England Gasket of Bristol, Conn.) to the dimensions of 2.25"×8.5"×0.0625." Place the felt on top of the unscored, green side of the cardboard such that the long edges of both the felt and cardboard are parallel and in alignment. Make sure the fluffy side of the felt is facing up. Also allow about 0.5" to overhang the top and bottom most edges of the cardboard. Snugly fold over both overhanging felt edges onto the backside of the cardboard with Scotch brand tape. Prepare a total of six of these felt/cardboard combinations.

For best reproducibility, all samples should be run with the same lot of felt. Obviously, there are occasions where a single lot of felt becomes completely depleted. In those cases where a new lot of felt must be obtained, a correction factor should be determined for the new lot of felt. To determine the correction factor, obtain a representative single tissue sample of interest, and enough felt to make up 24 cardboard/felt samples for the new and old lots.

As described below and before any rubbing has taken place, obtain Hunter L readings for each of the 24 cardboard/felt samples of the new and old lots of felt. Calculate the averages for both the 24 cardboard/felt samples of the old lot and the 24 cardboard/felt samples of the new lot.

Next, rub test the 24 cardboard/felt boards of the new lot and the 24 cardboard/felt boards of the old lot as described below. Make sure the same tissue lot number is used for each of the 24 samples for the old and new lots. In addition, sampling of the paper in the preparation of the cardboard/tissue samples must be done so the new lot of felt and the old lot of felt are exposed to as representative as possible of a tissue sample. For the case of 1-ply tissue product, discard any product which might have been damaged or abraded. Next, obtain 48 strips of tissue each two usable units (also termed sheets) long. Place the first two usable unit strip on the far left of the lab bench and the last of the 48 samples on the far right of the bench. Mark the sample to the far left with the number "1" in a 1 cm by 1 cm area of the corner of the sample. Continue to mark the samples consecutively up to 48 such that the last sample to the far right is numbered 48.

Use the 24 odd numbered samples for the new felt and the 24 even numbered samples for the old felt. Order the odd number samples from lowest to highest. Order the even numbered samples from lowest to highest. Now, mark the lowest number for each set with a letter "W." Mark the next highest number with the letter "N." Continue marking the samples in this alternating "W"/"N" pattern. Use the "W" samples for wire side out lint analyses and the "N" samples for non-wire side lint analyses. For 1-ply product, there are now a total of 24 samples for the new lot of felt and the old lot of felt. Of this 24, twelve are for wire side out lint analysis and 12 are for non-wire side lint analysis.

Rub and measure the Hunter Color L values for all 24 samples of the old felt as described below. Record the 12 wire side Hunter Color L values for the old felt. Average the 12 values. Record the 12 non-wire side Hunter Color L values for the old felt. Average the 12 values. Subtract the average initial un-rubbed Hunter Color L felt reading from the average Hunter Color L reading for the wire side rubbed samples. This is the delta average difference for the wire side samples. Subtract the average initial un-rubbed Hunter Color L felt reading from the average Hunter Color L reading for the non-wire side rubbed samples. This is the delta average difference for the non-wire side samples. Calculate the sum of the delta average difference for the wire side and the delta average difference for the non-wire side and divide this sum by 2. This is the uncorrected lint value for the old felt. If there is a current felt correction factor for the old felt, add it to the uncorrected lint value for the old felt. This value is the corrected Lint Value for the old felt.

Rub and measure the Hunter Color L values for all 24 samples of the new felt as described below. Record the 12 wire side Hunter Color L values for the new felt. Average the 12 values. Record the 12 non-wire side Hunter Color L values for the new felt. Average the 12 values. Subtract the average initial un-rubbed Hunter Color L felt reading from the average Hunter Color L reading for the wire side rubbed samples. This is the delta average difference for the wire side samples. Subtract the average initial un-rubbed Hunter Color L felt reading from the average Hunter Color L reading for the non-wire side rubbed samples. This is the delta average difference for the non-wire side samples. Calculate the sum of the delta average difference for the wire side and the delta average difference for the non-wire side and divide this sum by 2. This is the uncorrected lint value for the new felt.

Take the difference between the corrected Lint Value from the old felt and the uncorrected lint value for the new felt. This difference is the felt correction factor for the new lot of felt.

Adding this felt correction factor to the uncorrected lint value for the new felt should be identical to the corrected Lint Value for the old felt.

The same type procedure is applied to two-ply tissue product with 24 samples run for the old felt and 24 run for the new felt. But, only the consumer used outside layers of the plies are rub tested. As noted above, make sure the samples are prepared such that a representative sample is obtained for the old and new felts.

Care of Four Pound Weights

The four pound weight has four square inches of effective contact area providing a contact pressure of one pound per square inch. Since the contact pressure can be changed by alteration of the rubber pads mounted on the face of the weight, it is important to use only the rubber pads supplied by the manufacturer (Brown Inc., Mechanical Services Department, Kalamazoo, Mich.). These pads must be replaced if they become hard, abraded or chipped off.

When not in use, the weight must be positioned such that the pads are not supporting the full weight of the weight. It is best to store the weight on its side.

Rub Tester Instrument Calibration

The Sutherland Rub Tester must first be calibrated prior to use. First, turn on the Sutherland Rub Tester by moving the tester switch to the "cont" position. When the tester arm is in its position closest to the user, turn the tester's switch to the "auto" position. Set the tester to run 5 strokes by moving the pointer arm on the large dial to the "five" position setting. One stroke is a single and complete forward and reverse motion of the weight. The end of the rubbing block should be in the position closest to the operator at the beginning and at the end of each test.

Prepare a tissue paper on cardboard sample as described above. In addition, prepare a felt on cardboard sample as described above. Both of these samples will be used for calibration of the instrument and will not be used in the acquisition of data for the actual samples.

Place this calibration tissue sample on the base plate of the tester by slipping the holes in the board over the hold-down pins. The hold-down pins prevent the sample from moving during the test. Clip the calibration felt/cardboard sample onto the four pound weight with the cardboard side contacting the pads of the weight. Make sure the cardboard/felt combination is resting flat against the weight. Hook this weight onto the tester arm and gently place the tissue sample underneath the weight/felt combination. The end of the weight closest to the operator must be over the cardboard of the tissue sample and not the tissue sample itself. The felt must rest flat on the tissue sample and must be in 100% contact with the tissue surface. Activate the tester by depressing the "push" button.

Keep a count of the number of strokes and observe and make a mental note of the starting and stopping position of the felt covered weight in relationship to the sample. If the total number of strokes is five and if the end of the felt covered weight closest to the operator is over the cardboard of the tissue sample at the beginning and end of this test, the tester is calibrated and ready to use. If the total number of strokes is not five or if the end of the felt covered weight closest to the operator is over the actual paper tissue sample either at the beginning or end of the test, repeat this calibration procedure until 5 strokes are counted the end of the felt covered weight closest to the operator is situated over the cardboard at the both the start and end of the test.

During the actual testing of samples, monitor and observe the stroke count and the starting and stopping point of the felt covered weight. Recalibrate when necessary.

Hunter Color Meter Calibration

Adjust the Hunter Color Difference Meter for the black and white standard plates according to the procedures outlined in the operation manual of the instrument. Also run the stability check for standardization as well as the daily color stability check if this has not been done during the past eight hours. In addition, the zero reflectance must be checked and readjusted if necessary.

Place the white standard plate on the sample stage under the instrument port. Release the sample stage and allow the sample plate to be raised beneath the sample port.

Using the "L-Y", "a-X", and "b-Z" standardizing knobs, adjust the instrument to read the Standard White Plate Values of "L", "a", and "b" when the "L", "a", and "b" push buttons are depressed in turn.

Measurement of Samples

The first step in the measurement of lint is to measure the Hunter color values of the black felt/cardboard samples prior to being rubbed on the tissue. The first step in this measurement is to lower the standard white plate from under the instrument port of the Hunter color instrument. Center a felt covered cardboard, with the arrow pointing to the back of the color meter, on top of the standard plate. Release the sample stage, allowing the felt covered cardboard to be raised under the sample port.

Since the felt width is only slightly larger than the viewing area diameter, make sure the felt completely covers the viewing area. After confirming complete coverage, depress the L push button and wait for the reading to stabilize. Read and record this L value to the nearest 0.1 unit.

If a D25D2A head is in use, lower the felt covered cardboard and plate, rotate the felt covered cardboard 90 degrees so the arrow points to the right side of the meter. Next, release the sample stage and check once more to make sure the viewing area is completely covered with felt. Depress the L push button. Read and record this value to the nearest 0.1 unit. For the D25D2M unit, the recorded value is the Hunter Color L value. For the D25D2A head where a rotated sample reading is also recorded, the Hunter Color L value is the average of the two recorded values.

Measure the Hunter Color L values for all of the felt covered cardboards using this technique. If the Hunter Color L values are all within 0.3 units of one another, take the average to obtain the initial L reading. If the Hunter Color L values are not within the 0.3 units, discard those felt/cardboard combinations outside the limit. Prepare new samples and repeat the Hunter Color L measurement until all samples are within 0.3 units of one another.

For the measurement of the actual tissue paper/cardboard combinations, place the tissue sample/cardboard combination on the base plate of the tester by slipping the holes in the board over the hold-down pins. The hold-down pins prevent the sample from moving during the test. Clip the calibration felt/cardboard sample onto the four pound weight with the cardboard side contacting the pads of the weight. Make sure the cardboard/felt combination is resting flat against the weight. Hook this weight onto the tester arm and gently place the tissue sample underneath the weight/felt combination. The end of the weight closest to the operator must be over the cardboard of the tissue sample and not the tissue sample itself. The felt must rest flat on the tissue sample and must be in 100% contact with the tissue surface.

Next, activate the tester by depressing the "push" button. At the end of the five strokes the tester will automatically stop. Note the stopping position of the felt covered weight in relation to the sample. If the end of the felt covered weight toward the operator is over cardboard, the tester is operating properly. If the end of the felt covered weight toward the operator is over sample, disregard this measurement and recalibrate as directed above in the Sutherland Rub Tester Calibration section.

Remove the weight with the felt covered cardboard. Inspect the tissue sample. If torn, discard the felt and tissue and start over. If the tissue sample is intact, remove the felt covered cardboard from the weight. Determine the Hunter Color L value on the felt covered cardboard as described above for the blank felts. Record the Hunter Color L readings for the felt after rubbing. Rub, measure, and record the Hunter Color L values for all remaining samples.

After all tissues have been measured, remove and discard all felt. Felts strips are not used again. Cardboards are used until they are bent, torn, limp, or no longer have a smooth surface.

Calculations

Determine the delta L values by subtracting the average initial L reading found for the unused felts from each of the measured values for the wire side and the non-wire side of the sample. Recall, multi-ply-ply product will only rub one side of the paper. Thus, three delta L values will be obtained for the multi-ply product. Average the three delta L values and subtract the felt factor from this final average. This final result is termed the lint for the 2-ply product.

For the single-ply product where both wire side and non-wire side measurements are obtained, subtract the average initial L reading found for the unused felts from each of the three wire side L readings and each of the three non-wire side L readings. Calculate the average delta for the three wire side values. Calculate the average delta for the three non-wire side values. Subtract the felt factor from each of these averages. The final results are termed a lint for the non-wire side and a lint for the wire side of the single-ply product. By taking the average of these two values, an ultimate lint is obtained for the entire single-ply product.

E. Pulp Filtration Resistance (PFR)

The PFR is, like the Canadian Standard Freeness (CSF), a method for measuring the drainage rate of pulp slurries. It is believed that the PFR is a superior method for characterizing fibers with respect to their drainage characteristics. For purposes of estimation, the CSF may be related to the PFR by the following formula:

PFR=11270/CSF-10.77, where the PFR is in units of seconds and the CSF is in seconds of milliliters. Because this relationship is subject to error it should be used for estimation purposes only. A more accurate method of measuring the PFR is as follows.

The PFR is measured by discharging three successive aliquots of a 0.1% consistency slurry from a proportioner and filtering through a screen connected to the proportioner discharge. The time required to collect each aliquot is recorded and the screen is not removed or cleaned between filtrations.

The proportioner (obtained from Special Machinery Corporation, 546 Este Avenue, Cincinnati, Ohio 45232, Drawing #C-PP-318) is equipped with a PFR attachment (also obtained from Special Machinery Corporation, Drawing #4A-PP-103, part #8). The PFR attachment is loaded with a clean screen (a 1⅛ inch (2.9 cm) die cut circle of the same type of screen used for handsbeeting, Appleton Wire 84×76M, is used and it is loaded with the sheet side "up" in the tester).

A 0.10% consistency slurry of disintegrated pulp is prepared in the proportioner at a volume of 19 liters, with the PFR attachment in position. A 100 ml volumetric flask is positioned under the outlet of the PFR attachment. The proportioner outlet valve is opened and a timer started, the valve is closed and timer stopped the instant 100 ml is collected in the volumetric flask (additional liquid will probably drain into the flask after the valve is closed). The time is recorded to the nearest 0.10 seconds, noted as "A".

The filtrate is discarded, the flask repositioned, and another 100 ml aliquot is collected by the same procedure without removing or cleaning the screen between filtrations. This time interval is recorded as "B". Again, the filtrate is discarded, the flask repositioned, and another 100 ml aliquot is collected by the same procedure without removing or cleaning the screen between filtrations. This time interval is recorded as "C".

PFR is then calculated using the following equation:

$$PFR = \sqrt{\frac{(E)\times(B+C-(2\times A))}{1.5}}$$

where A, B, and C are the recorded time intervals, and E is a function of temperature used to correct the PFR to the value that would be observed at 75° F. (24° C.)

E=1 +(0.013.times.(T-75))

where T is the slurry temperature measured to the nearest degree F in the proportioner after taking the last aliquot.

EXAMPLES

The following nonlimiting examples are provided to illustrate the preparation of paper products according to the present invention. The scope of the invention is to be determined by the claims which follow.

Example 1

This example is intended to demonstrate preparation of low density tissue having temporary wet strength according to the prior art.

A commercial Fourdrinier papermaking machine is used in the practice of the present invention.

An aqueous slurry of Northern Softwood Kraft (NSK) of about 3.5% consistency is made up using a conventional repulper. Sufficient sodium hydroxide is added during repulping to adjust the pH to about 6 and the slurry is passed through a stock pipe toward the headbox of the Fourdrinier.

The slurry is passed through a refiner which fibrillates the NSK causing the pulp filtration resistance to increase by about 2.5seconds.

In order to impart dry strength to the finished product, a 1.5% dispersion of RediBOND 5330® (a cationic starch available from National Starch and Chemical Company, (Bridgewater, N.J.) is prepared and is added to the NSK stock pipe at a rate sufficient to deliver 0.17% RediBOND 5330® based on the dry weight of the NSK fibers. The absorption of the dry strength resin is enhanced by passing the treated slurry through an in-line mixer.

In order to impart a temporary wet strength to the finished product, a 1.5% dispersion of Parez 750® is prepared and is added to the NSK stock pipe at a rate sufficient to deliver 0.42% Parez 750B® based on the dry weight of the NSK fibers. The absorption of the temporary wet strength resin is enhanced by passing the treated slurry through an in-line mixer.

An aqueous slurry of Eucalyptus Hardwood Kraft fibers of about 3.5% consistency is made up using a conventional repulper. Sufficient sodium hydroxide is added during repulping to adjust the pH to about 6 and the slurry is passed through a stock pipe toward the headbox of the Fourdrinier.

The NSK fibers are diluted with white water at the inlet of a fan pump to a consistency of about 0.15% based on the total weight of the NSK fiber slurry. The eucalyptus fibers, likewise, are diluted with white water at the inlet of a fan pump to a consistency of about 0.15% based on the total weight of the eucalyptus fiber slurry. The eucalyptus slurry and the NSK slurry are both directed to a layered headbox capable of maintaining the slurries as separate streams until they are deposited onto a forming fabric on the Fourdrinier.

The paper machine has a layered beadbox having a top chamber, a center chamber, and a bottom chamber. The eucalyptus fiber slurry is pumped through the top and bottom headbox chambers and, simultaneously, the NSK fiber slurry is pumped through the center headbox chamber and delivered in superposed relation onto the Fourdrinier wire to form thereon a three-layer embryonic web, of which about 70% is made up of the eucalyptus fibers and 30% is made up of the NSK fibers. Dewatering occurs through the Fourdrinier wire and is assisted by a deflector and vacuum boxes. The Fourdrinier wire is of a 5-shed, satin weave configuration having 87 machine-direction and 76 cross-machine-direction direction monofilaments per inch, respectively. The embryonic web is transferred from the Fourdrinier wire, at a fiber consistency of about 22% at the point of transfer, to a patterned drying fabric.

The drying fabric is designed to yield a pattern-densified tissue and has a 5 shed satin weave configuration having 44 machine-direction and 33 cross-machine-direction direction monofilaments per inch. The filament crossovers are sanded to provide a knuckle area of about 38%.

The web is carried on the drying fabric past the vacuum dewatering box, through the blow-through predryers after which the web is transferred onto a Yankee dryer. The fiber consistency is about 27% after the vacuum dewatering box and, by the action of the predryers, about 65% prior to transfer onto the Yankee dryer; creping adhesive comprising a 0.25% aqueous solution of polyvinyl alcohol is spray-applied to the Yankee dryer surface; the fiber consistency is increased to an estimated 98% before dry creping the web with a doctor blade. The doctor blade has a bevel angle of 26 degrees and is positioned with respect to the Yankee dryer to provide an impact angle of about 81 degrees; the Yankee dryer is operated at about 340° F. (171° C.); the Yankee dryer is operated at about 3800 feet per minute (180 meters per minute). The web is then passed between two calender rolls and wound on a reel.

The resulting paper was evaluated according to the methods described herein with the results being provided in Table 1.

TABLE 1

| Test Parameter | Result |
|---|---|
| Density | 0.26 grams/cm$^3$ |
| Basis Weight | 11 grams/m$^2$ |
| Total Dry Strength | 411 grams/inch (162 grams/cm) |
| Total Initial Wet Strength | 44 grams/inch (17 grams/cm) |
| Total Thirty Minute Wet Strength | 15.2 grams/inch (6 grams/cm) |
| Total Dry Tensile Modulus | 13.0 grams/cm % |
| Wet Burst | 21 grams |
| Lint Resistance | 7 |

The ratio of initial wet strength to dry strength for the paper made according to Example 1 is 0.11:1 and the ratio of thirty minute wet strength to initial wet strength for the paper made according to Example 1 is 0.35:1

Example 2

This example is intended to demonstrate preparation of low density tissue having temporary wet strength according to one aspect of the present invention.

A commercial Fourdrinier papermaking machine is used in the practice of the present invention.

An aqueous slurry of Northern Softwood Kraft (NSK) of about 3.5% consistency is made up using a conventional repulper Sufficient sodium hydroxide is added during repulping to adjust the pH to about 6 and the slurry is passed through a stock pipe toward the headbox of the Fourdrinier.

Sulfuric acid at a concentration of 1% is added to the NSK stock pipe in a controlled manner so as to control the pH of the slurry to about 5.1±0.2.

In order to impart a temporary wet strength to the finished product, a 1.5% dispersion of Parez 750B® is prepared and is added to the NSK stock pipe at a rate sufficient to deliver 1.4% Parez 750B®) based on the dry weight of the NSK fibers. The absorption of the temporary wet strength resin is enhanced by passing the treated slurry through an in-line mixer.

Additional sulfuric acid at a concentration of 1% is added to the treated NSK slurry in order to control the headbox pH to 5.1±0.2

An aqueous slurry of Eucalyptus Hardwood Kraft fibers of about 3.5% consistency is made up using a conventional repulper Sufficient sodium hydroxide is added during repulping to adjust the pH to about 5.7 and the slurry is passed through a stock pipe toward the headbox of the Fourdrinier.

Sulfuric acid at a concentration of 1% is added to the Eucalyptus stock pipe in a controlled manner so as to control the pH of the Eucalyptus slurry to 5.1±0.2

In order to impart a temporary wet strength to the finished product, a 1.5% dispersion of Parez 750B® is prepared and is added to the Eucalyptus stock pipe at a rate sufficient to deliver 0.12% Parez 750® based on the dry weight of the Eucalyptus fibers. The absorption of the temporary wet strength resin is enhanced by passing the treated slurry through an in-line mixer.

Additional sulfuric acid at a concentration of 1% is added to the treated Eucalyptus slurry in order to control the headbox pH to 5.1±0.2

The NSK fibers are diluted with white water at the inlet of a fan pump to a consistency of about 0.15% based on the total weight of the NSK fiber slurry forming a portion of the headbox furnish. The eucalyptus fibers, likewise, are diluted with white water at the inlet of a fan pump to a consistency of about 0.15% based on the total weight of the eucalyptus fiber slurry forming a second portion of the headbox furnish. The eucalyptus slurry and the NSK slurry are both directed to a layered headbox capable of maintaining the slurries as separate streams until they are deposited onto a forming fabric on the Fourdrinier.

The paper machine has a layered headbox having a top chamber, a center chamber, and a bottom chamber. The eucalyptus fiber slurry is pumped through the top and bottom headbox chambers and, simultaneously, the NSK fiber slurry is pumped through the center headbox chamber and delivered in superposed relation onto the Fourdrinier wire to form thereon a three-layer embryonic web, of which about 78% is made up of the eucalyptus fibers and 22% is made up of the NSK fibers. Dewatering occurs through the Fourdrinier wire and is assisted by a deflector and vacuum boxes. The Fourdrinier wire is of a 5-shed, satin weave configuration having 87 machine-direction and 76 cross-machine-direction direction monofilaments per inch, respectively. The embryonic web is transferred from the Fourdrinier wire, at a fiber consistency of about 22% at the point of transfer, to a patterned drying fabric.

The drying fabric is designed to yield a pattern-densified tissue with discontinuous low-density deflected areas arranged within a continuous network of high density (knuckle) areas. This drying fabric is formed by casting an impervious resin surface onto a fiber mesh supporting fabric. The supporting fabric is a 48×52 filament, dual layer mesh. The thickness of the resin cast above the surface of the secondary is about 5.5 mils. The knuckle area is about 36% and the open cells are present at a frequency of about 575 per square inch.

The web is carried on the drying fabric past the vacuum dewatering box, through the blow-through predryers after which the web is transferred onto a Yankee dryer. The fiber consistency is about 27% after the vacuum dewatering box and, by the action of the predryers, about 65% prior to transfer onto the Yankee dryer; creping adhesive comprising a 0.25% aqueous solution of polyvinyl alcohol is spray-applied to the Yankee dryer surface by applicators; the fiber consistency is increased to an estimated 98% before dry creping the web with a doctor blade. The doctor blade has a bevel angle of 26 degrees and is positioned with respect to the Yankee dryer to provide an impact angle of about 81 degrees; the Yankee dryer is operated at about 340° F. (171° C.); the Yankee dryer is operated at about 3400 feet per minute (161 meters per minute). The web is then passed between two calender rolls and wound on a reel.

The resulting paper was evaluated according to the methods described herein with the results being provided in Table 2.

TABLE 2

| Test Parameter | Result |
|---|---|
| Density | 0.21 grams/cm$^3$ |
| Basis Weight | 13.5 grams/m$^2$ |
| Total Dry Strength | 380 grams/inch (150 grams/cm) |
| Total Initial Wet Strength | 85 grams/inch (33 grams/cm) |
| Total Thirty Minute Wet Strength | 32 grams/inch (13 grams/cm) |
| Total Dry Tensile Modulus | 7.9 grams/cm % |
| Wet Burst | 46 grams |
| Lint Resistance | 7 |

The ratio of initial wet strength to dry strength for the paper made according to Example 2 is 0.22:1 and the ratio of thirty minute wet strength to initial wet strength for the paper made according to Example 2 is 0.38:1.

Example 3

This example is intended to demonstrate preparation of low density tissue having temporary wet strength according to a second aspect of the present invention.

A commercial Fourdrinier papermaking machine is used in the practice of the present invention.

An aqueous slurry of Northern Softwood Kraft ASK) of about 3.5% consistency is made up using a conventional repulper. Sufficient sodium hydroxide is added during repulping to adjust the pH to about 6 and the slurry is passed through a stock pipe toward the headbox of the Fourdrinier.

Sulfuric acid at a concentration of 1% is added to the NSK stock pipe in a controlled manner so as to control the pH of the slurry to 5.1±0.2.

In order to impart a temporary wet strength to the finished product, a 1.5% dispersion of Parez EXPN 3683 is prepared and is added to the NSK stock pipe at a rate sufficient to deliver 0.91% Parez EXPN 3683 based on the dry weight of the NSK fibers. The absorption of the temporary wet strength resin is enhanced by passing the treated slurry through an in-line mixer.

Additional sulfuric acid at a concentration of 1% is added to the treated NSK slurry to control the pH to 5.1±0.2.

An aqueous slurry of Eucalyptus Hardwood Kraft fibers of about 3.5% consistency is made up using a conventional repulper Sufficient sodium hydroxide is added during repulping to adjust the pH to about 6 and the slurry is passed through a stock pipe toward the headbox of the Fourdrinier.

Sulfuric acid at a concentration of 1% is added to the Eucalyptus stock pipe in a controlled manner so as to control the pH of the Eucalyptus slurry to5.1±0.2.

In order to impart a temporary wet strength to the finished product, a 1.5% dispersion of Parez EXPN 3683 is prepared and is added to the Eucalyptus stock pipe at a rate sufficient to deliver 0.12% Parez EXPN 3683 based on the dry weight of the Eucalyptus fibers. The absorption of the temporary wet strength resin is enhanced by passing the treated slurry through an in-line mixer.

Additional sulfuric acid at a concentration of 1% is added to the treated Eucalyptus slurry in order to control the headbox pH to 5.1±0.2

The NSK fibers are diluted with white water at the inlet of a fan pump to a consistency of about 0.15% based on the total weight of the NSK fiber slurry forming a portion of the headbox furnish. The eucalyptus fibers, likewise, are diluted with white water at the inlet of a fan pump to a consistency of about 0.15% based on the total weight of the eucalyptus fiber slurry forming a second portion of the headbox furnish. The eucalyptus slurry and the NSK slurry are both directed to a layered headbox capable of maintaining the slurries as separate streams until they are deposited onto a forming fabric on the Fourdrinier.

The paper machine has a layered headbox having a top chamber, a center chamber, and a bottom chamber. The eucalyptus fiber slurry is pumped through the top and bottom headbox chambers and, simultaneously, the NSK fiber slurry is pumped through the center headbox chamber and delivered in superposed relation onto the Fourdrinier wire to form thereon a three-layer embryonic web, of which about 78% is made up of the eucalyptus fibers and 22% is made up of the NSK fibers. Dewatering occurs through the Fourdrinier wire and is assisted by a deflector and vacuum boxes. The Fourdrinier wire is of a 5-shed, satin weave configuration having 87 machine-direction and 76 cross-machine-direction direction monofilaments per inch, respectively. The embryonic web is transferred from the Fourdrinier wire, at a fiber consistency of about 22% at the point of transfer, to a patterned drying fabric.

The drying fabric is designed to yield a pattern-densified tissue with discontinuous low-density deflected areas arranged within a continuous network of high density (knuckle) areas. This drying fabric is formed by casting an impervious resin surface onto a fiber mesh supporting fabric. The supporting fabric is a 48×52 filament, dual layer mesh. The thickness of the resin cast above the surface of the secondary is about 5.5 mils. The knuckle area is about 36% and the open cells are present at a frequency of about 562 per square inch.

The web is carried on the drying fabric past the vacuum dewatering box, through the blow-through predryers after which the web is transferred onto a Yankee dryer. The fiber consistency is about 27% after the vacuum dewatering box and, by the action of the predryers, about 65% prior to transfer onto the Yankee dryer; creping adhesive comprising a 0.25% aqueous solution of polyvinyl alcohol is spray-applied to the Yankee dryer surface by applicators; the fiber consistency is increased to an estimated 98% before dry creping the web with a doctor blade. The doctor blade has a bevel angle of 26 degrees and is positioned with respect to the Yankee dryer to provide an impact angle of about 81 degrees; the Yankee dryer is operated at about 340° F. (171° C.); the Yankee dryer is operated at about 3400 feet per minute (161 meters per minute). The web is then passed between two calender rolls and wound on a reel.

The resulting paper was evaluated according to the methods described herein with the results being provided in Table 3.

TABLE 3

| Test Parameter | Result |
|---|---|
| Density | 0.20 grams/cm$^3$ |
| Basis Weight | 13.5 grams/m$^2$ |
| Total Dry Strength | 407 grams/inch (160 grams/cm) |
| Total Initial Wet Strength | 89 grams/inch (35 grams/cm) |
| Total Thirty Minute Wet Strength | 29 grams/inch (11 grams/cm) |
| Total Dry Tensile Modulus | 7.7 grams/cm % |
| Wet Burst | 46 grams |
| Lint Resistance | 7 |

The ratio of initial wet strength to dry strength for the paper made according to Example 3 is 0.22:1 and the ratio of thirty minute wet strength to initial wet strength for the paper made according to Example 3 is 0.33:1

Example 4

This example is intended to demonstrate that low density tissue prepared according to the present invention has softness that is comparable to low density tissue prepared according to the prior art.

Tissue prepared according to Examples 2 and 3 were evaluated for panel softness according to the method described in the TEST METHODS section. Tissue prepared according to Example 1 is used as the control tissue. The results of this evaluation are given in Table 4

TABLE 4

| Sample | Softness (PSU) |
|---|---|
| Tissue According to Example 2 | −0.09 |
| Tissue According to Example 3 | +0.02 |

As can be seen, tissue prepared according to the present invention has softness that is comparable to tissue prepared according to the prior art.

The disclosures of all patents, patent applications (and any patents which issue thereon, as well as any corresponding published foreign patent applications), and publications mentioned throughout this description are hereby incorporated by reference herein. It is expressly not admitted, however, that any of the documents incorporated by reference herein teach or disclose the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A soft low density paper product with temporary wet strength, said paper product having a density, a basis weight, a wet burst strength, an initial wet strength, a thirty minute wet strength, and a dry strength, said paper product comprising:

papermaking fibers wherein said papermaking fibers comprise between about 13% and about 25% softwood fibers; and a chemical strength additive consisting essentially of a temporary wet strength resin;

wherein said density is less than about 0.6 grams per cubic centimeter, said basis weight is between about 10 and about 65 grams per square meter, said dry strength is less than about 500 grams per inch (197 grams per centimeter), said wet burst strength is at least about 35 grams, the ratio of said initial wet strength to said dry strength is greater than about 0.15:1, and the ratio of said thirty minute wet strength to said initial wet strength is less than about 0.4.

2. A soft low density paper product according to claim 1 wherein said dry strength is less than about 450 grams per inch (177 grams per centimeter).

3. A soft low density paper product according to claim 2 wherein said dry strength is less than about 425 grams per inch (167 grams per centimeter).

4. A soft low density paper product according to claim 3 wherein said dry strength is less than about 375 grams per inch (148 grams per centimeter).

5. A soft low density paper product according to claim 1 wherein said ratio of said initial wet strength to said dry strength is greater than about 0.2:1 .

6. A soft low density paper product according to claim 5 wherein said ratio of said initial wet strength to said dry strength is greater than about 0.25:1.

7. A soft low density paper product according to claim I wherein said ratio of said thirty minute wet strength to said initial wet strength is less than about 0.4:1.

8. A soft low density paper product according to claim 7 wherein said ratio of said thirty minute wet strength to said initial wet strength is less than about 0.3:1.

9. A soft low density paper product according to claim 1 wherein said temporary wet strength resin is used at a level of between about 0.2% and about 0.8%.

10. A soft low density paper product according to claim 1 wherein said paper product is layered, having two outer layers and a center layer therebetween.

11. A soft low density paper product according to claim 10 wherein said papermaking fibers comprise both softwood fibers and short fibers, wherein said papermaking fibers in said center layer consist essentially of softwood papermaking fibers and said papermaking fibers in said outer layers consist essentially of short papermaking fibers.

12. A soft low density paper product according to claim 11 wherein said paper product comprises between about 13% and about 25% softwood fibers.

13. A soft low density paper product according to claim 1 wherein said softwood fibers are refined so as to provide a change in PFR of between 0 and about 1.5 seconds.

14. A soft low density paper product according to claim 1 wherein said paper product has a total tensile modulus and said total tensile modulus is less than about 12 grams/cm%.

15. A soft low density paper product according to claim 1 wherein said wet burst strength is between about 35 grams and about 70 grams.

16. A soft low density paper product according to claim 1 wherein said paper product is pattern densified having a relatively high bulk field of relatively low fiber density and an array of densified zones of relatively high fiber density.

17. A soft low density paper product according to claim 16 wherein said densified zones are interconnected.

18. A soft low density paper product according to claim 1 wherein said temporary wet strength resin comprises a cationic polyaldebyde polymer.

19. A soft low density paper product according to claim 11 wherein both said center layer and said outer layers are provided with a temporary wet strength resin.

20. A soft low density paper product according to claim 19 wherein said center layer is provided with said temporary wet strength resin at a first level and said outer layers are provided with said temporary wet strength resin at a second, lower level.

21. A soft low density paper product according to claim 20 wherein said temporary wet strength resin comprises a cationic polyaldehyde polymer.

22. A soft low density paper product according to claim 20 wherein said paper product has a lint value and said lint value is less than about 8.

23. A soft low density paper product with temporary wet strength, said paper product having a density less than about 0.6 grams per cubic centimeter, a basis weight between about 10 and about 65 grams per square meter, an initial wet strength, a thirty minute wet strength, a dry strength less than about 500 grams per inch (197 grams per centimeter), a wet burst strength between about 35 grams and about 70 grams, wherein the ratio of said initial wet strength to said dry strength is greater than about 0.15:1, and the ratio of said thirty minute wet strength to said initial wet strength is less than about 0.4, said paper product comprising:

two outer layers comprising short papermaking fibers and a temporary wet strength resin; and an inner layer positioned between said outer layers, said inner layer comprising softwood long papermaking fibers and a temporary wet strength resin;

wherein said softwood papermaking fibers comprise between about 13% and about 25% of the total combined weight of said short papermaking fibers and said softwood papermaking fibers and the level of said temporary wet strength resin in said outer layers is between about 0.1% and about 0.2% of the combined weight of said short papermaking fibers and said softwood papermaking fibers and the level of said temporary wet strength resin in said inner layer is between about 0.2% and about 0.4% of the combined weight of said short papermaking fibers and said softwood papermaking fibers.

24. A soft low density paper product according to claim 23 wherein said paper product has a lint value and said lint value is less than about 8.

25. A method of preparing a papermaking furnish for producing a soft, low density paper product with temporary wet strength of claim 1, said method comprising:

a) providing a first aqueous slurry comprising softwood papermaking fibers, said first slurry having a first pH;

b) providing means to adjust said first pH and adjusting said first pH to a first controlled pH range that is between about 5.0 and about 6.5;

c) providing first acid means to adjust said first controlled pH range to a second, more narrowly controlled pH range that is between about 4.8 and about 5.4;

d) providing a temporary wet strength resin solution;

e) mixing said slurry, said first acid means, and said temporary wet strength resin solution so as to provide a first initially conditioned, resin treated softwood papermaking fiber slurry;

f) providing second acid means to adjust said second controlled pH range so as to control the pH of said papermaking furnish to a range that is between about 4.8 and about 5.4;

g) providing dilution water; and h) mixing said initially conditioned, resin treated softwood papermaking fiber slurry, said second acid means, and said dilution water to complete preparation of said papermaking furnish.

26. A method for producing a soft low density paper product, said method comprising:

a) directing a first papermaking furnish prepared according to claim 25 to a headbox and depositing said first furnish onto a foraminous substrate therewith, forming an embryonic web; and b) drying said embryonic web to form a web of said soft low density paper product, wherein said product has a density of less than about 0.6 grams per cubic centimeter, a basis weight between about 10 and about 65 grams per square meter, a dry strength less than about 500 grams per inch (197 grams per centimeter), a ratio of an initial wet strength to said dry strength greater than about 0.15:1, and a ratio of a thirty minute wet strength to said initial wet strength less than about 0.4.

27. The method of claim 26 wherein said paper product is layered with two outer layers and a center layer therebetween and said headbox has three chambers, a pair of outer chambers and a center chamber therebetween, said method further comprises:

a) directing said first paper making furnish is directed to said center chamber;

b) preparing a second papermaking furnish by:

i) providing a second aqueous slurry comprising short papermaking fibers, said slurry having a fourth pH;

ii) providing means to adjust said fourth pH and adjusting said fourth pH to a third controlled pH range that is between about 5.0 and about 6.5;

iii) providing third acid means to adjust said third controlled pH range to a fourth, more narrowly controlled pH range that is between about 4.8 and about 5.4;

iv) providing a temporary wet strength resin solution;

v) mixing said slurry, said third acid means and said temporary wet strength resin solution so as to provide a second initially conditioned, resin treated, short papermaking fiber slurry;

vi) providing fourth acid means to adjust said fourth controlled pH range so as to control the pH of said second papermaking furnish to a range that is between about 4.8 and about 5.4;

vii) providing dilution water;

viii) mixing said second initially conditioned, resin treated, short papermaking fiber slurry, said fourth acid means, and said dilution water to complete preparation of said second papermaking furnish;

c) dividing said second furnish into first and second portions; and d) directing said first portion to one of said outer chambers and said second portion to the other of said outer chambers.

28. The method of claim 27, said method further comprising:

a) depositing said furnishes onto a foraminous substrate forming an embryonic web; and b) drying said embryonic web to form a web of said soft low density paper product, wherein said product has a density of less than about 0.6 grams per cubic centimeter, a basis weight between about 10 and about 65 grams per square meter, a dry strength less than about 500 grams per inch (197 grams per centimeter), a ratio of an initial wet strength to said dry strength greater than about 0.15:1, and a ratio of a thirty minute wet strength to said initial wet strength less than about 0.4.

29. The method of claim 28 wherein the embryonic web is dried using a method comprising:

a) transferring said embryonic web from said foraminous substrate to a carrier fabric;

b) blowing heated air through said embryonic web and said carrier fabric to form a semidry embryonic tissue paper web;

c) transferring said semidry embryonic tissue paper web to a Yankee drier;

d) drying said semi-dry embryonic tissue paper web on said Yankee drier and creping said dried web therefrom to form a dried web; and e) winding said dried web upon a reel.

30. The method of claim 29 wherein said carrier fabric is an imprinting carrier fabric having an interconnected pattern of knuckles.

31. The method of claim 28 wherein the embryonic web is dried using a method comprising:

a) transferring said embryonic web from said foraminous substrate to a carrier fabric to form a shortened embryonic web;

b) transferring said shortened embryonic web to a dryer fabric;

c) blowing heated air through said shortened embryonic web and said dryer fabric to form a dried web; and d) winding said dried web upon a reel.

32. A soft, low density paper product made according to the method of claim 26.

33. A soft, low density paper product made according to the method of claim 28.

* * * * *

UNITED STATES PATENT AND TRADEMARK OFFICE

CERTIFICATE OF CORRECTION

PATENT NO. : 6,149,769
DATED : November 21, 2000
INVENTOR(S) : Khosrow P. Mohammadi et al.

It is certified that error appears in the above-identified patent and that said Letters Patent is hereby corrected as shown below:

Column 1,
Line 14, "modem" should read -- modern --.
Line 24, "his her" should read -- his/her --.
Line 25, "his her" should read -- his/her --.

Column 3,
Line 2, "rams" should read -- grams --.

Column 5,
Line 33, "I" should read -- 1 --.

Column 6,
Line 35, "I" should read -- 1 --.

Column 10,
Line 16, "Tinting" should read -- linting --.
Line 49, "Willington, should read -- Wilmington, --.
Line 55, "gymnosperns" should read -- gymnosperms --.

Column 12,
Line 58, "beadbox" should read -- headbox --.

Signed and Sealed this

Eighteenth Day of June, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,149,769
DATED : November 21, 2000
INVENTOR(S) : Khosrow P. Mohammadi et al.

It is certified that error appears in the above-identified patent and that said Letters Patent is hereby corrected as shown below:

Column 1,
Line 14, "modem" should read -- modern --.
Line 24, "his her" should read -- his/her --.
Line 25, "his her" should read -- his/her --.

Column 3,
Line 2, "rams" should read -- grams --.

Column 5,
Line 33, "I" should read -- 1 --.

Column 6,
Line 35, "I" should read -- 1 --.

Column 10,
Line 16, "Tinting" should read -- linting --.
Line 49, "Willington", should read -- Wilmington, --.
Line 55, "gymnosperns" should read -- gymnosperms --.

Column 12,
Line 58, "beadbox" should read -- headbox --.

Column 16,
Line 2, "glcm" should read -- g/cm --.

Column 23,
Line 25, "handsbeeting" should read -- handsheeting --.

UNITED STATES PATENT AND TRADEMARK OFFICE

CERTIFICATE OF CORRECTION

PATENT NO. : 6,149,769
DATED : November 21, 2000
INVENTOR(S) : Khosrow P. Mohammadi et al.

It is certified that error appears in the above-identified patent and that said Letters Patent is hereby corrected as shown below:

Column 24,
Line 41, “beadbox” should read -- headbox --.

This certificate supersedes Certificate of Correction issued on June 18, 2002.

Signed and Sealed this

Third Day of September, 2002

*Attest:*

*Attesting Officer*

JAMES E. ROGAN
*Director of the United States Patent and Trademark Office*